US010865464B2

(12) United States Patent
Martin et al.

(10) Patent No.: US 10,865,464 B2
(45) Date of Patent: *Dec. 15, 2020

(54) MATERIALS AND METHODS FOR PRODUCING METAL NANOCOMPOSITES, AND METAL NANOCOMPOSITES OBTAINED THEREFROM

(71) Applicant: HRL Laboratories, LLC, Malibu, CA (US)

(72) Inventors: John H. Martin, Los Angeles, CA (US); Brennan D. Yahata, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 68 days.

This patent is subject to a terminal disclaimer.

(21) Appl. No.: 15/808,877

(22) Filed: Nov. 9, 2017

(65) Prior Publication Data

US 2018/0133789 A1 May 17, 2018

Related U.S. Application Data

(60) Provisional application No. 62/422,925, filed on Nov. 16, 2016, provisional application No. 62/422,930,
(Continued)

(51) Int. Cl.
*B32B 15/00* (2006.01)
*C22C 1/04* (2006.01)
(Continued)

(52) U.S. Cl.
CPC ..... *C22C 1/0416* (2013.01); *B22D 23/06* (2013.01); *B22F 1/0044* (2013.01); *C22C 1/05* (2013.01);
(Continued)

(58) Field of Classification Search
None
See application file for complete search history.

(56) References Cited

U.S. PATENT DOCUMENTS 5,305,726 A 4/1994 Scharman et al.
5,340,012 A 8/1994 Beeferman et al.
(Continued)

FOREIGN PATENT DOCUMENTS

CN 102441672 A 5/2012
CN 103045914 A 4/2013
(Continued)

OTHER PUBLICATIONS

Chen et al., "Rapid control of phase growth by nanoparticles," Nature Communications 5:3879 DOI: 10.1038/ncomms4879.
(Continued)

*Primary Examiner* — Seth Dumbris
(74) *Attorney, Agent, or Firm* — O'Connor & Company

(57) ABSTRACT

Some variations provide a metal matrix nanocomposite composition comprising metal-containing microparticles and nanoparticles, wherein the nanoparticles are chemically and/or physically disposed on surfaces of the microparticles, and wherein the nanoparticles are consolidated in a three-dimensional architecture throughout the composition. The composition may serve as an ingot for producing a metal matrix nanocomposite. Other variations provide a functionally graded metal matrix nanocomposite comprising a metal-matrix phase and a reinforcement phase containing nanoparticles, wherein the nanocomposite contains a gradient in concentration of the nanoparticles. This nanocomposite may be or be converted into a master alloy. Other variations provide methods of making a metal matrix nanocomposite, methods of making a functionally graded metal matrix nanocomposite, and methods of making a master alloy metal matrix nanocomposite. The metal matrix nanocomposite
(Continued)

may have a cast microstructure. The methods disclosed enable various loadings of nanoparticles in metal matrix nanocomposites with a wide variety of compositions.

9 Claims, 15 Drawing Sheets

Related U.S. Application Data filed on Nov. 16, 2016, provisional application No. 62/422,940, filed on Nov. 16, 2016.

(51) Int. Cl.

| | |
|---|---|
| ***C22C 32/00*** | (2006.01) |
| ***C22C 1/10*** | (2006.01) |
| ***B22D 23/06*** | (2006.01) |
| ***B22F 1/00*** | (2006.01) |
| ***C22C 1/05*** | (2006.01) |
| ***C22C 21/02*** | (2006.01) |

(52) U.S. Cl.

CPC ..... *C22C 1/1036* (2013.01); *C22C 21/02* (2013.01); *C22C 32/00* (2013.01); *B22F 2301/052* (2013.01); *B22F 2302/10* (2013.01); *B22F 2998/10* (2013.01); *C22C 32/0052* (2013.01); *Y10T 428/12021* (2015.01)

(56) References Cited

U.S. PATENT DOCUMENTS

| | | | | |
|---|---|---|---|---|
| 5,462,712 | A | 10/1995 | Langan et al. | |
| 5,965,197 | A * | 10/1999 | Jin | B23K 35/0244 427/180 |
| 6,024,915 | A * | 2/2000 | Kume | B22F 1/02 419/35 |
| 6,071,628 | A | 6/2000 | Seals et al. | |
| 6,254,757 | B1 | 7/2001 | Lashmore et al. | |
| 6,368,427 | B1 | 4/2002 | Sigworth | |
| 6,652,967 | B2 | 11/2003 | Yadav et al. | |
| 6,855,426 | B2 | 2/2005 | Yadav | |
| 9,238,877 | B2 | 1/2016 | Krause et al. | |
| 2002/0136884 | A1 | 9/2002 | Oechsner | |
| 2003/0077473 | A1 | 4/2003 | Bretschneider et al. | |
| 2003/0104147 | A1 | 6/2003 | Bretschneider et al. | |
| 2005/0238528 | A1 | 10/2005 | Lin et al. | |
| 2006/0065330 | A1 | 3/2006 | Cooper et al. | |
| 2007/0102199 | A1 | 5/2007 | Smith et al. | |
| 2008/0044685 | A1 | 2/2008 | Jin | |
| 2008/0128176 | A1 | 6/2008 | Choe et al. | |
| 2010/0288243 | A1 | 11/2010 | Kaburagi et al. | |
| 2012/0012777 | A1* | 1/2012 | Sugiyama | B22F 1/0062 252/62.54 |
| 2012/0024109 | A1* | 2/2012 | Xu | B22F 1/025 75/243 |
| 2012/0135142 | A1 | 5/2012 | Yang et al. | |
| 2012/0315399 | A1 | 12/2012 | Feng et al. | |
| 2013/0012643 | A1 | 1/2013 | Monsheimer et al. | |
| 2013/0020377 | A1 | 1/2013 | Stankowski et al. | |
| 2013/0146041 | A1 | 6/2013 | Hijii et al. | |
| 2013/0152739 | A1 | 6/2013 | Li et al. | |
| 2013/0300066 | A1* | 11/2013 | Xu | E21B 33/12 277/336 |
| 2015/0252451 | A1 | 9/2015 | Al-Aqeeli et al. | |
| 2015/0337423 | A1 | 11/2015 | Martin et al. | |
| 2016/0279703 | A1* | 9/2016 | Clare | B22F 1/0014 |
| 2017/0016095 | A1 | 1/2017 | Karlen et al. | |
| 2017/0252851 | A1 | 9/2017 | Fulop et al. | |
| 2018/0214991 | A1 | 8/2018 | Yahata et al. | |

FOREIGN PATENT DOCUMENTS

| | | | |
|---|---|---|---|
| JP | 2011054892 | A | 3/2011 |
| KR | 1020080105250 | A | 12/2008 |
| WO | 2005017220 | A1 | 2/2005 |

OTHER PUBLICATIONS

Sheppard et al., "The Mechanochemical synthesis of magnesium hydride nanoparticles" Journal of Alloys and Compounds 492 (2010) L72-L74.

Zhu et al., "Growth Mechanism for the Controlled Synthesis of MgH2/Mg Crystals via a Vapor-Solid Process" Cryst. Growth Des. 2011, 11, 4166-4174.

Högberg et al., "Reactive sputtering of δ-ZrH2 thin films by high power impulse magnetron sputtering and direct current magnetron sputtering," Journal of Vacuum Science & Technology A 2014, 32, 041510.

Gharatloo et al., "Ultrasound-assisted synthesis of nano-structured zirconium hydride at room temperature," International Journal of Hydrogen Energy 40 (2015) 13942-13948.

Mukherjee et al., "Printability of alloys for additive manufacturing" Scientific Reports | 6:19717 | DOI: 10.1038/srep19717, Jan. 22, 2016.

He et al., "Alloying element vaporization during laser spot welding of stainless steel" J. Phys. D: Appl. Phys. 36 (2003) 3079-3088.

Bartkowiak et al.,"New Developments of Laser Processing Aluminium Alloys via Additive Manufacturing Technique" Physics Procedia 12 (2011) 393-401.

Zhang et al., "Grain Refinement and Mechanical Properties of Cu—Cr—Zr Alloys with Different Nano-Sized TiCp Addition" Materials 2017, 10, 919; doi:10.3390/ma10080919.

Roberts et al., "A novel processing approach for additive manufacturing of commercial aluminum alloys" Physics Procedia 83 ( 2016 ) 909-917.

Martin et al., "3D printing of high-strength aluminium alloys" Nature, vol. 549, Sep. 21, 2017.

Melgarejo et al., "Microstructure and properties of functionally graded Al-Mg-B composites fabricated by centrifugal casting", Composites Part A, 1150-1158, 2008.

Birkholz et al., "Nanocomposite layers of ceramic oxides and metals prepared by reactive gas-flow sputtering", Surface and Coatings Technology, 179, 279-285, 2004.

Saravanan et al., "Effect of Mechanical Properties on Rice Husk Ash Reinforced Aluminum alloy (AlSilOMg) Matrix Composites", Procedia Engineering 64, 1505-1513, 2013.

* cited by examiner

MATERIALS AND METHODS FOR PRODUCING METAL NANOCOMPOSITES, AND METAL NANOCOMPOSITES OBTAINED THEREFROM

PRIORITY DATA

This patent application is a non-provisional application with priority to U.S. Provisional Patent App. No. 62/422,925, filed on Nov. 16, 2016; U.S. Provisional Patent App. No. 62/422,930, filed on Nov. 16, 2016; and U.S. Provisional Patent App. No. 62/422,940, filed on Nov. 16, 2016, each of which is hereby incorporated by reference herein.

FIELD OF THE INVENTION

The present invention generally relates to metal matrix nanocomposites, and methods of making and using the same.

BACKGROUND OF THE INVENTION

Metal matrix nanocomposite materials have attracted considerable attention due to their ability to offer unusual combinations of stiffness, strength to weight ratio, high-temperature performance, and hardness. There is a wide variety of commercial uses of metal matrix nanocomposites, including high-wear-resistant alloy systems, creep-resistant alloys, high-temperature alloys with improved mechanical properties, and radiation-tolerant alloys.

Currently, there are difficulties in making metal matrix nanocomposites including processing costs and high capital investment for equipment to process materials. There are very few effective methods of maintaining a homogenously dispersed nanoparticle reinforcement phase in a metal matrix, especially in melt processing. Reinforcement phase reactivity and particulate agglomeration of nanoscale reinforcement limit the strengthening effects in currently produced metal matrix nanocomposites.

There is a desire for lower-cost routes to produce these high-performance nanocomposites, including low-volume-fraction nanocomposites as well as high-volume-fraction nanocomposites (i.e. nanocomposites containing various concentrations of nanoparticles).

Current methods for producing low-volume-fraction nanocomposites are limited to in-situ reaction mechanisms in highly specific alloy systems. These include oxide dispersion-strengthened copper and steels in which oxide formers such as aluminum are incorporated into the alloy in order to scavenge dissolved oxygen and form nano-oxides. Similar techniques can be used for nitrides and carbides. These techniques require substantial atmosphere control and temperature control to ensure that the nucleation rate within the material is stable, so that significant coarsening does not occur. The materials are therefore extremely expensive and geometry-limited. Due to the kinetics of diffusion, nucleation, and growth, geometries must be relatively uniform and thin to allow uniform composite formation. Thick sections take much longer for the center of the material to begin nucleating oxides, nitrides, or carbides. Thus the material cannot be made with uniform properties through the thickness.

High volume loading of nanoscale reinforcements ex situ is limited to few processes and none with the capability of producing geometrically complex shapes and at a low cost. Current melt processing methods such as shear mixing or ultrasonic processing of metal matrix nanocomposites suffer from a limited availability of compatible materials due to reactivity and dispersion issues. These methods are capable of dispersing low volume percentages of certain reinforcement phases; however, complications arise at higher reinforcement volume loading percentages as the effects of dispersion become more localized and less effective at higher melt viscosities.

Current methods to produce high-volume-fraction nanocomposites rely on a variety of high-cost methods to incorporate the nanoparticles. These can be incorporated using high-energy ball milling which physically forces the nanomaterials into the matrix material, and then the remaining material is processed into a part. This requires batch processing. Also, very large high-energy ball mills present both cost and safety barriers. Nanomaterials may also be incorporated in the melt, but distribution of the nanomaterials can be difficult due to the surface energies associated with liquid metal. Ultrasonic mixing or high-shear mixing can be effective, but they are size-limited and require manipulation of molten metal, which again presents cost and safety barriers. Another method utilizes the semisolid state in which particles are incorporated through a friction stir process. This is highly localized and not immediately scalable.

There is also a desire for functionally graded metal matrix nanocomposites that contain some type of functional gradient (e.g., nanoparticle concentration) within the nanocomposite. Functionally graded metal matrix nanocomposites have not yet been successfully produced with a conventional melt processing method, due in large part to the high reactivity of reinforcement phase in a metal melt.

Homogeneously dispersed metal matrix nanocomposites have been produced using high-energy ultrasonication to enhance dispersion and wetting characteristics of nanoparticles in metal melts. This technique relies on cavitation of gases and acoustically driven mixing of particulate added ex situ into the melt. Functionally graded materials have not been produced in this manner due to particulate instability in the lengthy processing needed for full dispersion. The ultrasonication process is inherently limited to particulates that are highly stable in the molten matrix during processing and solidification.

Additionally, wettability of many potential reinforcement phases disqualifies them from being used in ex-situ melt processing techniques where inclusion of the particulate phase into the melt is highly dependent on wettability of the particulate phase with the metal matrix. Particulate-matrix compatibility requirements inhibit the availability of acceptable reinforcement phases in metal matrix nanocomposite production. Additionally, the loading of high volumes of nanoparticles becomes problematic in ultrasonic dispersion techniques as the effect of dispersion becomes more localized at high melt viscosities induced by high-volume loading of a reinforcement phase.

Friction stir processing can produce metal matrix nanocomposites by driving the particulate phase into the metal through the semisolid created by friction with a probe. Friction stir processing has been used to produce functionally graded metal matrix nanocomposites; however, this process is geometrically constrained and cannot be used with metals and alloys without a viable semisolid processing region. Friction stir processing can alter the microstructural integrity of the bulk material, as large amounts of heat from the friction produced affect the surrounding microstructures near the processing zone. Also, thickness of parts produced in friction stir processing is limited to a few inches. Scaling of friction stir processing is very limited and production of high volumes of metal matrix nanocomposites is not feasible.

The current high cost, lack of availability, and lack of alloy diversity currently available for nanocomposites is a testament to the difficulty in producing these materials.

Conventional melt processing techniques such as liquid stir processing, semisolid stir processing, and ultrasonic processing are capable of dispersing low volumes of reinforcement phase which are nonreactive with the metal melt. What is desired is a method that enables both high volume loading and reactive reinforcement phases.

What is also sought is a method of producing a functionally graded metal matrix nanocomposite that is amenable to conventional melt processing techniques, with a wide variety of acceptable materials that may be used. A method is needed to produce a functionally graded metal matrix nanocomposite in which processing times are limited so that nanoparticles do not degrade during processing.

SUMMARY OF THE INVENTION

The present invention addresses the aforementioned needs in the art, as will now be summarized and then further described in detail below.

Some variations of the invention provide a composition comprising metal-containing microparticles and nanoparticles, wherein the nanoparticles are chemically and/or physically disposed on surfaces of the microparticles, and wherein the nanoparticles are consolidated in a three-dimensional architecture throughout the composition.

In some embodiments, the composition is an ingot for producing a metal nanocomposite. In other embodiments, the composition itself is a metal nanocomposite.

The microparticles may contain an element selected from the group consisting of Al, Mg, Ni, Fe, Cu, Ti, V, Si, and combinations thereof, for example. The nanoparticles may contain a compound selected from the group consisting of metals, ceramics, cermets, intermetallic alloys, oxides, carbides, nitrides, borides, polymers, carbon, and combinations thereof, for example. In certain embodiments, the microparticles contain Al, Si, and Mg (e.g., alloy AlSi10Mg), and the nanoparticles contain tungsten carbide (WC).

In some embodiments, the microparticles have an average microparticle size from about 1 micron to about 1 centimeter. In some embodiments, the nanoparticles have an average nanoparticle size from about 1 nanometer to about 1000 nanometers.

The composition may contain from about 10 wt % to about 99.9 wt % of microparticles. In these or other embodiments, the composition contains from about 0.1 wt % to about 10 wt % of the nanoparticles.

Other variations of the invention provide a functionally graded metal matrix nanocomposite comprising a metal-matrix phase and a first reinforcement phase containing first nanoparticles, wherein the nanocomposite contains a gradient in concentration of the first nanoparticles through at least one dimension of the nanocomposite. The gradient in concentration of the nanoparticles particles may be present in the nanocomposite over a length scale of at least 100 microns. The nanocomposite has a cast microstructure, in some embodiments.

In some embodiments, the nanocomposite is a master alloy. The metal-matrix phase may contain an element selected from the group consisting of Al, Mg, Ni, Fe, Cu, Ti, V, Si, and combinations thereof. The first nanoparticles may contain a compound selected from the group consisting of metals, ceramics, cermets, intermetallic alloys, oxides, carbides, nitrides, borides, polymers, carbon, and combinations thereof. In some embodiments, the metal-matrix phase contains Al, Si, and Mg, and the first nanoparticles contain tungsten carbide (WC).

The first nanoparticles may have an average particle size from about 1 nanometer to about 1000 nanometers. Some or all of the first nanoparticles may be agglomerated such that the effective particle size in the nanoparticle phase is larger than 1000 nanometers, in some embodiments.

The nanocomposite may contain from about 10 wt % to about 99.9 wt % of the metal-matrix phase, for example. The nanocomposite may contain from about 0.1 wt % to about 10 wt % of the first nanoparticles, for example.

In some embodiments, the nanocomposite further comprises second nanoparticles in the first reinforcement phase and/or in a second reinforcement phase.

In some embodiments, the metal-matrix phase and the first reinforcement phase are each dispersed throughout the nanocomposite. In these or other embodiments, the metal-matrix phase and the first reinforcement phase are disposed in a layered configuration within the nanocomposite, wherein the layered configuration includes at least a first layer comprising the first nanoparticles and at least a second layer comprising the metal-matrix phase.

The nanocomposite may be present in an object that has at least one dimension of 100 microns or greater, such as 1 millimeter or greater.

Certain variations of the invention provide a functionally graded metal matrix nanocomposite comprising a metal-matrix phase containing Al, Si, and Mg and a reinforcement phase containing W and C, wherein the nanocomposite contains a gradient in concentration of the reinforcement phase through at least one dimension of the nanocomposite. The nanocomposite may have a cast microstructure.

The metal-matrix phase contains aluminum alloy AlSi10Mg, in certain embodiments. The reinforcement phase contains tungsten carbide (WC), in certain embodiments. In some embodiments, the metal-matrix phase and the reinforcement phase are disposed in a layered configuration within the nanocomposite, wherein the layered configuration includes a first layer comprising the W and C and the Al, Si, and Mg, and a second layer comprising the Al, Si, and Mg.

Other variations of the invention provide a method of making a metal nanocomposite, the method comprising:

(a) providing a precursor composition comprising metal-containing microparticles and nanoparticles, wherein the nanoparticles are chemically and/or physically disposed on surfaces of the microparticles;

(b) consolidating the precursor composition into an intermediate composition comprising the metal-containing microparticles and the nanoparticles, wherein the nanoparticles are consolidated in a three-dimensional architecture throughout the intermediate composition; and (c) processing the intermediate composition to convert the intermediate composition into a metal nanocomposite.

In some embodiments, the precursor composition is in powder form. In some embodiments, the intermediate composition is in ingot form. The final nanocomposite may have a cast microstructure, in some embodiments.

The microparticles may contain an element selected from the group consisting of Al, Mg, Ni, Fe, Cu, Ti, V, Si, and combinations thereof. The nanoparticles may contain a compound selected from the group consisting of metals, ceramics, cermets, intermetallic alloys, oxides, carbides, nitrides, borides, polymers, carbon, and combinations thereof.

In various embodiments, step (b) includes pressing, binding, sintering, or a combination thereof.

In various embodiments, step (c) includes pressing, sintering, mixing, dispersing, friction stir welding, extrusion, binding, melting, semi-solid melting, capacitive discharge sintering, casting, or a combination thereof.

In some embodiments, the metal phase and the first reinforcement phase are each dispersed throughout the nanocomposite. In these or other embodiments, the metal phase and the first reinforcement phase are disposed in a layered configuration within the nanocomposite, wherein the layered configuration includes at least a first layer comprising the nanoparticles and at least a second layer comprising the metal phase.

Other variations provide a method of making a functionally graded metal matrix nanocomposite, the method comprising:

(a) providing a precursor composition (e.g., powder) comprising metal-containing microparticles and nanoparticles, wherein the nanoparticles are chemically and/or physically disposed on surfaces of the microparticles;

(b) consolidating the precursor composition into an intermediate composition (e.g., ingot) comprising the metal-containing microparticles and the nanoparticles, wherein the nanoparticles are consolidated in a three-dimensional architecture throughout the intermediate composition;

(c) melting the intermediate composition to form a melt, wherein the melt segregates into a first phase comprising the metal-containing microparticles and a second phase comprising the nanoparticles; and (d) solidifying the melt to obtain a metal matrix nanocomposite with a gradient in concentration of the nanoparticles through at least one dimension of the nanocomposite.

The microparticles may contain an element selected from the group consisting of Al, Mg, Ni, Fe, Cu, Ti, V, Si, and combinations thereof. The nanoparticles may contain a compound selected from the group consisting of metals, ceramics, cermets, intermetallic alloys, oxides, carbides, nitrides, borides, polymers, carbon, and combinations thereof. In some embodiments, the microparticles contain Al, Si, and Mg, and the nanoparticles contain tungsten carbide (WC).

In various embodiments, step (b) includes pressing, binding, sintering, or a combination thereof.

In various embodiments, step (c) includes pressing, sintering, mixing, dispersing, friction stir welding, extrusion, binding, melting, semi-solid melting, capacitive discharge sintering, casting, or a combination thereof. Step (c) may also include holding the melt for an effective dwell time to cause density-driven segregation of the first phase from the second phase. The dwell time may be selected from about 1 minute to about 8 hours, for example. In some embodiments, step (c) includes exposing the melt to an external force selected from gravitational, centrifugal, mechanical, electromagnetic, or a combination thereof.

Step (d) may include directional solidification of the melt. In some embodiments, the nanocomposite has a cast microstructure. The metal-matrix phase and the first reinforcement phase may be each dispersed throughout the nanocomposite. In these or other embodiments, the metal-matrix phase and the first reinforcement phase are disposed in a layered configuration within the nanocomposite, wherein the layered configuration includes at least a first layer comprising the nanoparticles and at least a second layer comprising the metal-matrix phase.

The gradient in concentration of the nanoparticles may be present in the nanocomposite over a length scale of at least 100 microns.

Other variations of the invention provide a method of making a master alloy metal matrix nanocomposite, the method comprising:

(a) providing an ingot composition comprising metal-containing microparticles and nanoparticles, wherein the nanoparticles are chemically and/or physically disposed on surfaces of the microparticles, and wherein the nanoparticles are consolidated in a three-dimensional architecture throughout the ingot composition;

(b) melting the ingot composition to form a melt, wherein the melt segregates into a first phase comprising the metal-containing microparticles and a second phase comprising the nanoparticles;

(c) solidifying the melt to obtain a metal matrix nanocomposite with a gradient in concentration of the nanoparticles through at least one dimension of the nanocomposite; and (d) removing a fraction of the metal matrix nanocomposite containing a lower concentration of the nanoparticles compared to the remainder of the metal matrix nanocomposite, thereby producing a master alloy metal matrix nanocomposite.

The microparticles may contain an element selected from the group consisting of Al, Mg, Ni, Fe, Cu, Ti, V, Si, and combinations thereof. The nanoparticles may contain a compound selected from the group consisting of metals, ceramics, cermets, intermetallic alloys, oxides, carbides, nitrides, borides, polymers, carbon, and combinations thereof. In certain embodiments, the microparticles contain Al, Si, and Mg, and the nanoparticles contain tungsten carbide (WC).

Step (b) may further include pressing, sintering, mixing, dispersing, friction stir welding, extrusion, binding, capacitive discharge sintering, casting, or a combination thereof. Step (b) may include holding the melt for an effective dwell time (e.g., about 1 minute to 8 hours) to cause density-driven segregation of the first phase from the second phase. Optionally, step (b) may include exposing the melt to an external force selected from gravitational, centrifugal, mechanical, electromagnetic, or a combination thereof.

Step (c) may include directional solidification of the melt. In some embodiments, the metal matrix nanocomposite in step (c) is characterized by a cast microstructure. The gradient in concentration of the first nanoparticles may be present in the metal matrix nanocomposite over a length scale of at least 100 microns.

In some embodiments, the metal-matrix phase and the first reinforcement phase are each dispersed throughout the metal matrix nanocomposite. In these or other embodiments, the metal-matrix phase and the first reinforcement phase are disposed in a layered configuration within the metal matrix nanocomposite, wherein the layered configuration includes at least a first layer comprising the nanoparticles and at least a second layer comprising the metal-matrix phase.

Step (d) may include includes machining, ablation, reaction, dissolution, evaporation, selective melting, or a combination thereof. In certain embodiments, step (d) provides two distinct master alloy metal matrix nanocomposites.

The final master alloy metal matrix nanocomposite(s) may have a cast microstructure, in some embodiments of the invention.

BRIEF DESCRIPTION OF THE DRAWINGS

The schematic drawings herein represent functionalization patterns and microstructures which may be achieved in embodiments of the invention. These drawings should not be construed as limiting in any way. It is also noted that illustrations contained in the drawings are not drawn to scale and various degrees of zooming-in are employed for purposes of understanding these embodiments.

DETAILED DESCRIPTION OF EMBODIMENTS OF THE INVENTION

Figure 1:
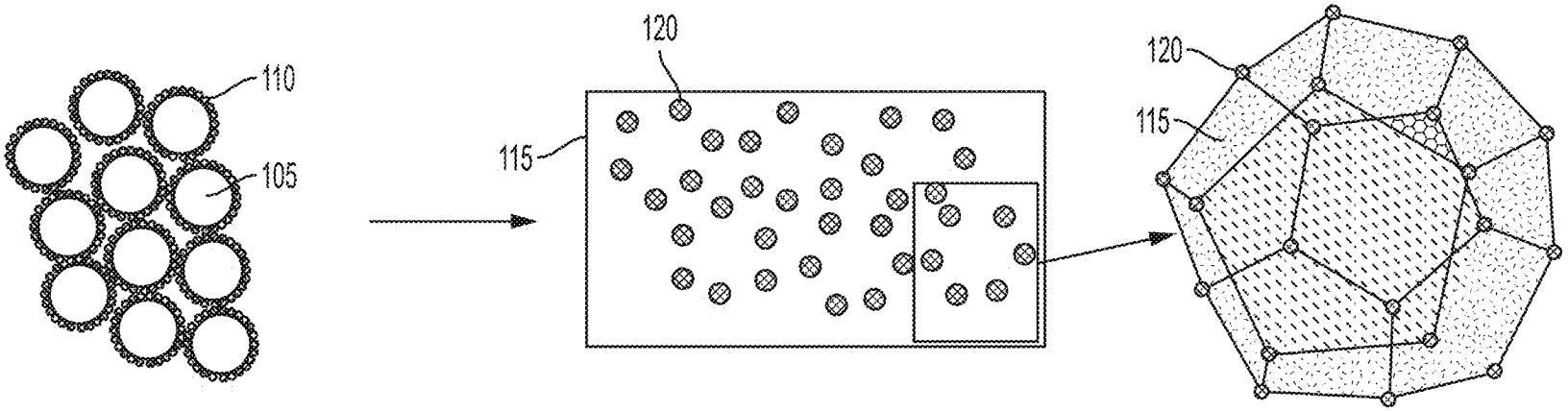
FIG. 1 depicts some embodiments in which a functionalized powder containing metal microparticles coated with nanoparticles is converted to an ingot (or other material) with the nanoparticles oriented in a three-dimensional structure.

The compositions, structures, systems, and methods of the present invention will be described in detail by reference to various non-limiting embodiments.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with the accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Variations of this invention are predicated on the control of solidification of powder materials. Controlling solidification can have a drastic impact on microstructure and thus material properties (e.g. strength and toughness). In some cases faster solidification is desirable; while in other cases slow solidification may produce the desired microstructure. In certain cases it is not desirable to fully melt the powder; but rather to melt and solidify only at the powder surface. This invention provides routes to control—in both time and space—solidification in materials, utilizing surface functionalization of the primary powder being processed.

Some variations provide routes to controlled solidification of materials which are generally difficult or impossible to process otherwise. The principles disclosed herein may be applied to additive manufacturing as well as joining techniques, such as welding. Certain unweldable metals, such as high-strength aluminum alloys (e.g., aluminum alloys 7075, 7050, or 2199) would be excellent candidates for additive manufacturing but normally suffer from hot cracking. The methods disclosed herein allow these alloys to be processed with significantly reduced cracking tendency.

Proper control of solidification can lead to greater part reliability and enhanced yield. Some embodiments of the invention provide powder metallurgy-processed parts that are equivalent to machined parts. Some embodiments provide corrosion-resistant surface coatings that are formed during the part fabrication instead of as an extra step.

This disclosure describes control of nucleation and growth kinetics within the structure independent of, or in conjunction with, thermal input. This disclosure describes methods which incorporate phase and structure control to generate three-dimensional microstructural architecture. Methods for inclusion/contaminant removal are provided, as well as development of composite structures.

Variations of this invention are premised on controlling solidification through limiting or increasing thermal conductivity and/or radiation with the surroundings, utilizing enthalpies of formation and varying heat capacities to control thermal loads during solidification, and/or utilizing surface tension to control entrapment of desired species—or rejection of undesired species—in the final solidification product.

Some variations provide methods to control nanoparticle (or microparticle)/material segregation. When rapid solidification techniques are applied to powder processing, a unique microstructure may be developed. Likewise, the configuration of the nanoparticles or microparticles around the particles prior to melting may introduce a three-dimensional nanoparticle architecture within the overall microstructure.

Embodiments of this invention provide three-dimensional nanoparticle architectures within metal microstructures. Not wishing to be bound by theory, these architectures may significantly improve the material properties by impeding, blocking, or redirecting dislocation motion in specific directions. This discovery may be used to control failure mechanisms beyond prior-art isotropic or anisotropic materials.

The present invention is not limited to metallic materials and can provide similar benefits with a significantly less difficult, more repeatable, and energy-efficient production method. The semi-passive nature of the process typically requires no alteration of existing tooling and can be employed in existing manufacturing settings.

Production of Metal Matrix Nanocomposites

Some variations of the present invention provide starting materials or material systems useful for producing metal matrix nanocomposites, and metal matrix nanocomposites obtained therefrom. A "metal matrix nanocomposite" (or "MMNC") or equivalently "metal nanocomposite" is a metal-containing material with greater than 0.1 wt % nanoparticles distributed in a metal matrix or otherwise within the metal-containing material.

Nanocomposites have been shown to exhibit enhanced mechanical strength due to the ability to impede dislocation motion. This ability is not limited to room temperature and can improve a material's high-temperature strength and creep resistance. Nanocomposites can also improve wear and fouling resistance in certain sliding and high-friction environments. However, nanocomposites have been heretofore difficult to produce and therefore their use has been limited.

Variations of this invention are premised on the discovery of a pathway to produce metal matrix nanocomposites of arbitrary composition and with control of nanoparticle volume fraction. Starting with functionalized metal feedstocks as described later in the specification (section entitled "Functionalized Metal Feedstocks for Producing Metal Matrix Nanocomposites"), a low or high volume fraction of nanoparticles may be achieved. There may be a uniform or non-uniform distribution of nanoparticles within the matrix, by utilizing conventional, low-cost powder metallurgy approaches and ingot processing.

A "functionalized metal" or "functionalized metal feedstock" comprises a metal microparticle with one or more different nanoparticles assembled on the surface. The nanoparticles are typically a different composition than the base micropowder.

The nanoparticles are chemically and/or physically disposed on surfaces of the microparticles. That is, the nanoparticles may be attached using electrostatic forces, Van der Waals forces, chemical bonds, mechanical bonds, and/or any other force(s). A chemical bond is the force that holds atoms together in a molecule or compound. Electrostatic and Van der Waals forces are examples of physical forces that can cause bonding. A mechanical bond is a bond that arises when molecular entities become entangled in space. Typically, chemical bonds are stronger than physical bonds.

Nanoparticles of interest include carbides, nitrides, borides, oxides, intermetallics, or other materials which upon processing may form one or more of the aforementioned materials. The size, shape, and composition of the nanoparticles may vary widely. The nanoparticles typically have an average nanoparticle size from about 1 nanometer to about 1000 nanometers, such as about 250 nanometers or less. In some embodiments, strength increases are favored by smaller nanoparticles. In some applications, the material may be processed with larger constituent particles (such as about 250-1000 nanometers or larger) to produce a desirable material.

Some variations provide a cost-effective route to producing large-scale raw materials for the production of metal nanocomposites. Certain embodiments utilize functionalized powder feedstocks as described in U.S. patent application Ser. No. 15/209,903, filed on Jul. 14, 2016, which is hereby incorporated by reference herein. The present disclosure is not limited to those functionalized powders.

Some variations of the invention provide a metal matrix nanocomposite composition comprising metal-containing microparticles and nanoparticles, wherein the nanoparticles are chemically and/or physically disposed on surfaces of the microparticles, and wherein the nanoparticles are consolidated in a three-dimensional architecture throughout the composition.

A "three-dimensional architecture" means that the nanoparticles are not randomly distributed throughout the metal matrix nanocomposite. Rather, in a three-dimensional architecture of nanoparticles, there is some regularity in spacing between nanoparticles, in space (three dimensions). The average spacing between nanoparticles may vary, such as from about 1 nanoparticle diameter to about 100 nanoparticle diameters or more, depending on the nanoparticle concentration in the material.

In some embodiments, the three-dimensional architecture of nanoparticles in the metal matrix nanocomposite is correlated to the distribution of nanoparticles within the starting composition (functional microparticles, i.e. metal-containing microparticles with nanoparticles on surfaces). An illustration of this is shown in FIG. 1. Such a three-dimensional architecture of nanoparticles is possible when the kinetics during melting and solidification are controlled such that the integrity and dispersion of nanoparticles are preserved.

In some embodiments, the nanoparticles do not melt and do not significantly disperse from the original dispositions, relative to each other, following melting of the metal matrix and then during solidification. In certain embodiments, the nanoparticles melt, soften (such as to become a glass), or form a liquid-solution solution, yet do not significantly disperse from the original dispositions, relative to each other, following melting of the metal matrix and/or during solidification. When such nanoparticles resolidify (or undergo a phase transition) during solidification of the melt, they assume their original dispositions or approximate coordinates thereof. In some embodiments, whether or not the nanoparticles melt, the nanoparticles end up in a three-dimensional architecture in which the locations of nanoparticles are different than the original dispositions, but may be correlated and therefore predictable based on the starting functionalized feedstock.

In some embodiments, the composition is an ingot for producing a metal matrix nanocomposite. In other embodiments, the composition itself is a metal matrix nanocomposite.

The microparticles may contain an element selected from the group consisting of Al, Mg, Ni, Fe, Cu, Ti, V, Si, and combinations thereof, for example. The nanoparticles may contain a compound selected from the group consisting of metals, ceramics, cermets, intermetallic alloys, oxides, carbides, nitrides, borides, polymers, carbon, and combinations thereof, for example. In certain embodiments, the microparticles contain Al, Si, and Mg (e.g., alloy AlSi10Mg), and the nanoparticles contain tungsten carbide (WC).

Some variations of the invention provide a method of making a metal matrix nanocomposite, the method comprising:

(a) providing a precursor composition comprising metal-containing microparticles and nanoparticles, wherein the nanoparticles are chemically and/or physically disposed on surfaces of the microparticles;

(b) consolidating the precursor composition into an intermediate composition comprising the metal-containing microparticles and the nanoparticles, wherein the nanoparticles are consolidated in a three-dimensional architecture throughout the intermediate composition; and (c) processing the intermediate composition to convert the intermediate composition into a metal matrix nanocomposite.

In some embodiments, the precursor composition is in powder form. In some embodiments, the intermediate composition is in ingot form.

The microparticles may contain an element selected from the group consisting of Al, Mg, Ni, Fe, Cu, Ti, V, Si, and combinations thereof. The nanoparticles may contain a compound selected from the group consisting of metals, ceramics, cermets, intermetallic alloys, oxides, carbides, nitrides, borides, polymers, carbon, and combinations thereof. Typically, the compositions of the microparticles and nanoparticles are different, although it is possible for the chemical composition to be the same or similar while there are differences in physical properties (particle size, phases, etc.).

The composition may contain from about 10 wt % to about 99.9 wt % of microparticles. In these or other embodiments, the composition contains from about 0.1 wt % to about 10 wt % of nanoparticles. Higher concentrations of nanoparticles are possible, particularly when regions with lower concentration are physically removed (as discussed later). A metal matrix nanocomposite may be identified as a "cermet" when metal content is low, such as 20 wt % or less.

In some embodiments, at least 1% of the surface area of the microparticles contains nanoparticles that are chemically and/or physically disposed on the microparticle surfaces. When higher nanoparticle concentrations are desired in the final material, it is preferred that a higher surface area of the microparticles contains nanoparticles. In various embodiments, at least 1%, 2%, 5%, 10%, 20%, 30%, 40%, 50%, 60%, 70%, 80%, 90%, or 95% of the total surface area of the microparticles contains nanoparticles that are chemically and/or physically disposed on the microparticle surfaces.

In some embodiments, the microparticles have an average microparticle size from about 1 micron to about 1 centimeter. In various embodiments, the average microparticle size is about 5 microns, 10 microns, 50 microns, 100 microns, 200 microns, 500 microns, 1 millimeter, 5 millimeters, or 10 millimeters.

In some embodiments, the nanoparticles have an average nanoparticle size from about 1 nanometer to about 1000 nanometers. In various embodiments, the average nanoparticle size is about 2, 5, 10, 25, 50, 100, 200, 300, 400, 500, 600, 700, 800, or 900 nanometers.

In some embodiments, the metal matrix has a density from about 2 $g/cm^3$ to about 10 $g/cm^3$. In some embodiments, the nanoparticles independently have a density from about 1 $g/cm^3$ to about 20 $g/cm^3$.

"Consolidating" and "consolidation" refer to the conversion of a precursor composition (e.g., feedstock powder) into an intermediate composition comprising the metal-containing microparticles and the nanoparticles. In various embodiments, consolidating in step (b) includes pressing, binding, sintering, or a combination thereof. Consolidating may alternatively or additionally include metal injection molding, extruding, isostatic pressing, powder forging, spray forming, metal additive manufacturing, and/or other known techniques. The intermediate composition produced by step (b) may be referred to as a green body.

In various embodiments, processing in step (c) includes pressing, sintering, mixing, dispersing, friction stir welding, extrusion, binding (such as with a polymer binder), melting, semi-solid melting, sintering, casting, or a combination thereof. Melting may include induction melting, resistive melting, skull melting, arc melting, laser melting, electron beam melting, semi-solid melting, or other types of melting (including convention and non-conventional melt processing techniques). Casting may include centrifugal, pour, or gravity casting, for example. Sintering may include spark discharge, capacitive-discharge, resistive, or furnace sintering, for example. Mixing may include convection, diffusion, shear mixing, or ultrasonic mixing, for example.

Steps (b) and (c) collectively convert the precursor composition (e.g., the functionalized powder) into a green body or a finished body which may then be used for additional post processing, machined to a part, or other uses.

In some embodiments, the metal-matrix phase and the first reinforcement phase are each dispersed throughout the nanocomposite. In these or other embodiments, the metal-matrix phase and the first reinforcement phase are disposed in a layered configuration within the nanocomposite, wherein the layered configuration includes at least a first layer comprising the nanoparticles and at least a second layer comprising the metal-matrix phase.

The final metal matrix nanocomposite may have a cast microstructure, in some embodiments. By a "cast microstructure" it is meant that the metal matrix nanocomposite is characterized by a plurality of dendrites and grain boundaries within the microstructure. In some embodiments, there is also a plurality of voids, but preferably no cracks or large phase boundaries. A dendrite is a characteristic tree-like structure of crystals produced by faster growth of crystals along energetically favorable crystallographic directions as molten metal freezes.

Note that while casting is a metal processing technique, a cast microstructure is a structural feature, not necessarily tied to any particular process to make the microstructure. A cast microstructure can certainly result from freezing (solidification) of molten metal or metal alloy. However, metal solidification can result in other microstructures, and cast microstructures can arise from other metal-forming techniques. Metal processes that do not rely at all on melting and solidification (e.g., forming processes) will not tend to produce a cast microstructure.

A cast microstructure can generally be characterized by primary dendrite spacing, secondary dendrite spacing, dendritic chemical segregation profile, grain size, shrinkage porosity (if any), percent of secondary phases, composition of secondary phases, and dendritic/equiaxed transition, for example.

In some embodiments of the present invention, a cast microstructure is further characterized by an equiaxed, fine-grained microstructure. "Equiaxed" grains means that the grains are roughly equal in length, width, and height. Equiaxed grains can result when there are many nucleation sites arising from the plurality of nanoparticles contained on surfaces of microparticles, in the functionalized metal feedstock and therefore in the final metal matrix nanocomposite.

In some embodiments of the present invention, a cast microstructure is further characterized by a dispersed microstructure. A dispersed microstructure generally arises from the large number of dendrites and grain boundaries within the microstructure, which in turn arise from the large number of nanoparticles on surfaces of microparticles. The degree of dispersion may be characterized by a dispersion length scale, calculated as the average spacing between nanoparticles and/or the average length scale in the metal phase between nanoparticles. In various embodiments, the dispersion length scale is from about 1 nanometer to about 100 microns, such as from about 10 nanometers to about 10 microns, or about 100 nanometers to about 1 micron.

Figure 10:
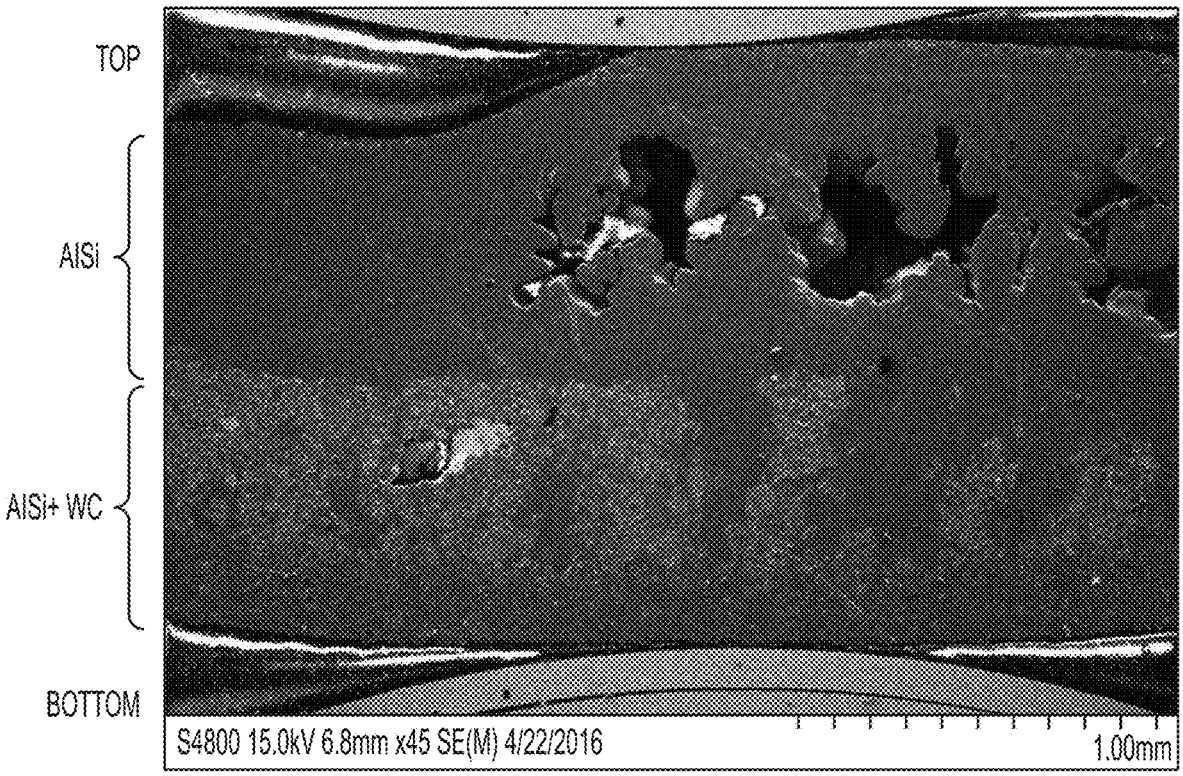
FIG. 10 is an SEM image of a cross-section (side view) of an exemplary AlSi10Mg—WC functionally graded metal matrix nanocomposite, according to Example 1 herein.
Figure 11:
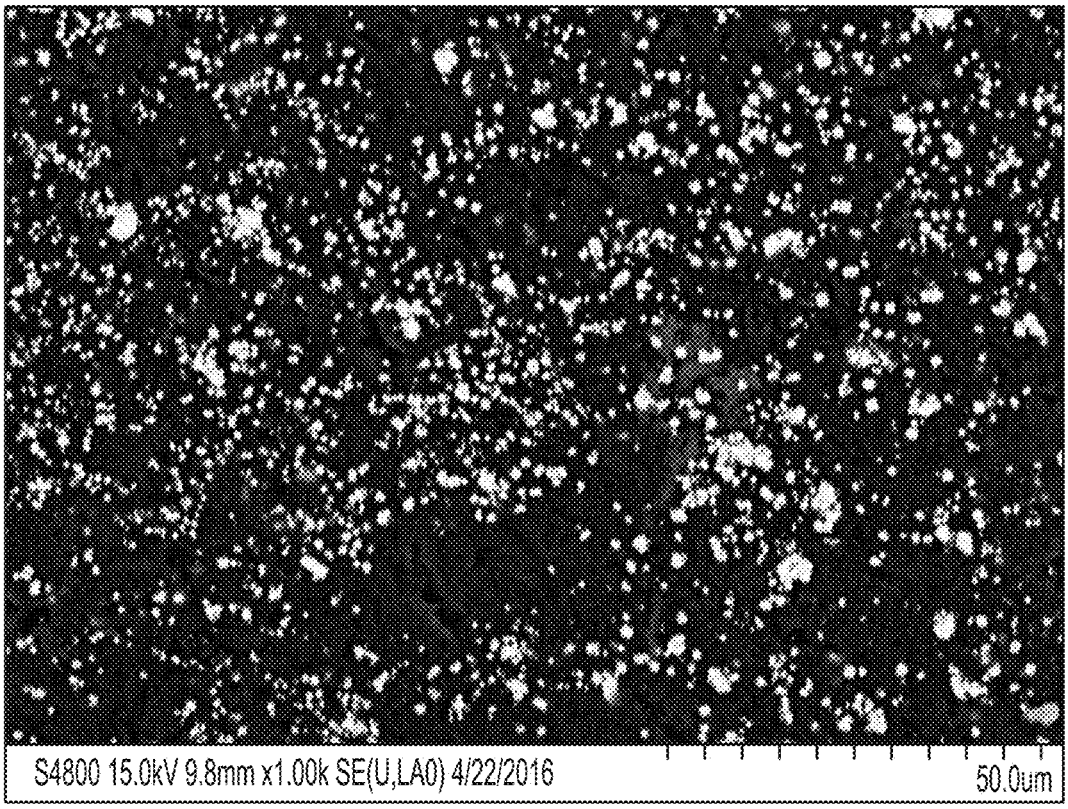
FIG. 11 is an SEM image of a cross-section (side view) of an exemplary AlSi10Mg—WC master alloy metal matrix nanocomposite, according to Example 2 herein.

Optionally, porosity may be removed or reduced in a cast microstructure. For example, a secondary heat and/or pressure (or other mechanical force) treatment may be done to minimize porous voids present in the metal matrix nanocomposite. Also, pores may be removed from the metal matrix nanocomposite by physically removing (e.g., cutting away) a region into which porous voids have segregated, such as via density-driven phase segregation. See FIGS. 10 and 11 for an example of this, in which voids present in the microstructure of FIG. 10 are removed to arrive at the dispersed microstructure of FIG. 11. The dispersion length scale in FIG. 11 is about 1-5 microns.

In addition to removal of voids, other post-working may be carried out, potentially resulting in other final microstructures that are not cast microstructures, or that contain a mixture of microstructures. For example, forging can refine defects from cast ingots or continuous cast bar, and can introduce additional directional strength, if desired. Pre-working (e.g., strain hardening) can be done such as to produce a grain flow oriented in directions requiring maximum strength. The final microstructure therefore may be a forged microstructure, or a mixed cast/forged microstructure, in certain embodiments. In various embodiments, the metal matrix microstructure, on a volume basis, is at least 10%, 25%, 50%, 75%, 90%, 95%, 99%, or 100% cast microstructure.

It is noted that friction stir processing requires rapid quenching to avoid settling and agglomeration that would occur during slow solidification. Rapid quenching tends to produce microstructures that are not cast microstructures as defined herein. Also, Bridgeman-type consolidation would be expected to present a microstructure that is not a dispersed cast microstructure.

Some variations of the present invention provide a raw material produced by a consolidation method of functionalized powder, to produce an ingot which may be used to make a nanocomposite, or is itself a nanocomposite. The metal alloys and nanoparticle compositions may vary widely, as described elsewhere. Metal matrix nanocomposites herein may be fabricated via compositional-bias assembly, density-bias assembly, hierarchical-size assembly, or other types of assembly of nanoparticles. The nanoparticles may stay the same composition upon ingot formation, the nanoparticles may react in some way to form a more favorable material for the nanocomposite, multiple different nanoparticles may be used, or any combination of this could occur.

Some graphical representations are shown in FIGS. 1 to 4, which are exemplary embodiments of metal matrix nanocomposites.

FIG. 1 depicts some embodiments in which a functionalized powder containing metal microparticles 105 coated with nanoparticles 110 is consolidated into an ingot (or other material), such as by application of heat and pressure, containing nanoparticles 120 distributed throughout a metal phase 115. The ingot 115/120 maintains a three-dimensional architecture of nanoparticles 120 uniformly distributed throughout the metal matrix 115. As shown in the zoomed-in portion of the ingot (right-hand side of FIG. 1), the nanoparticles 120 are oriented in a three-dimensional structure within the metal matrix 115. In some embodiments, the three-dimensional structure is predictable based on the starting material (i.e. the functionalized powder containing metal microparticles 105 coated with nanoparticles 110). That is, the dimensions of microparticles 105 and nanoparticles 110, and the spacing between individual microparticles 105 as well as between individual nanoparticles 110, can be correlated to the spacing (in three dimensions) between individual nanoparticles 110 within the metal phase 115 in the ingot.

Figure 2:
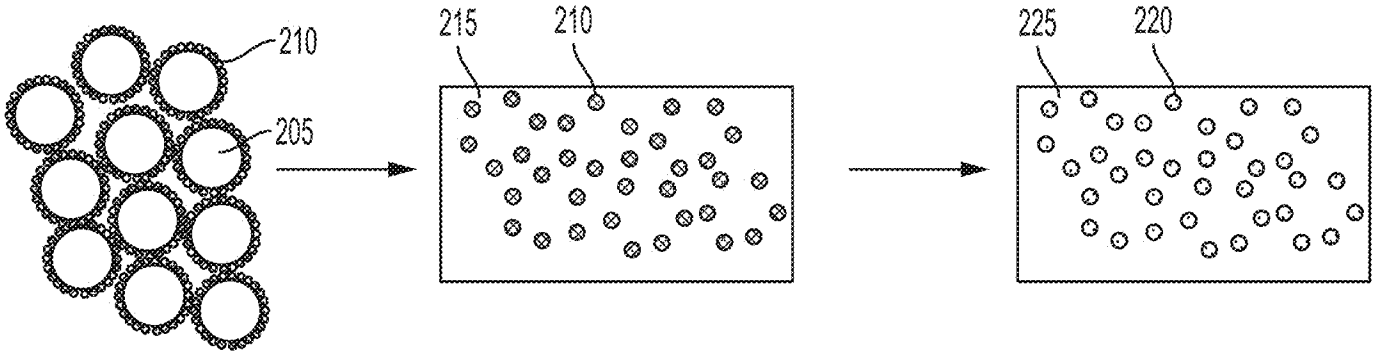
FIG. 2 depicts some embodiments in which a functionalized powder containing metal microparticles coated with nanoparticles is converted to a melt or ingot (or other material), and then the nanoparticles react in the melt to form a new distributed phase containing nanoparticles.

FIG. 2 depicts some embodiments in which a functionalized powder containing metal microparticles 205 coated with nanoparticles 210 is converted to a melt or ingot (or other material) containing nanoparticles 210 distributed throughout a metal phase 215. The nanoparticles 210 then react in the melt to form a new distributed phase 225 containing nanoparticles 220. The initial nanoparticles 210 have undergone a chemical transformation via reaction, with the metal phase 215, to form nanoparticles 220.

Figure 3:
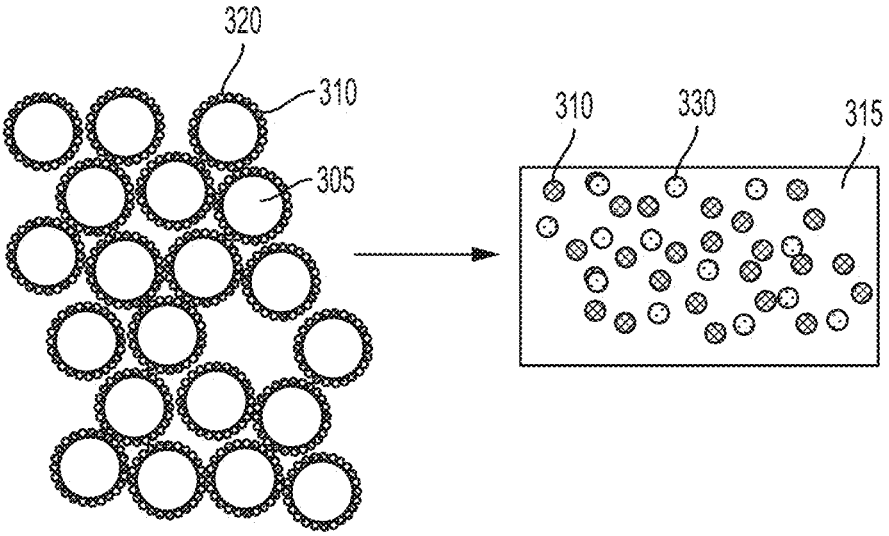
FIG. 3 depicts some embodiments starting with a functionalized powder containing metal microparticles coated with two types of nanoparticles, which are differently chemically and/or physically, and then the functionalized powder is converted to a melt or ingot (or other material) containing nanoparticles distributed in the metal phase.

FIG. 3 depicts some embodiments starting with a functionalized powder containing metal microparticles 305 coated with nanoparticles 310 and 320, which are different chemically and/or physically. Heat is applied and the functionalized powder is converted to a melt or ingot (or other material) containing nanoparticles 310 and 320 distributed in metal phase 315. The concentration of nanoparticles 310 and 320 may be uniform or non-uniform.

Figure 4:
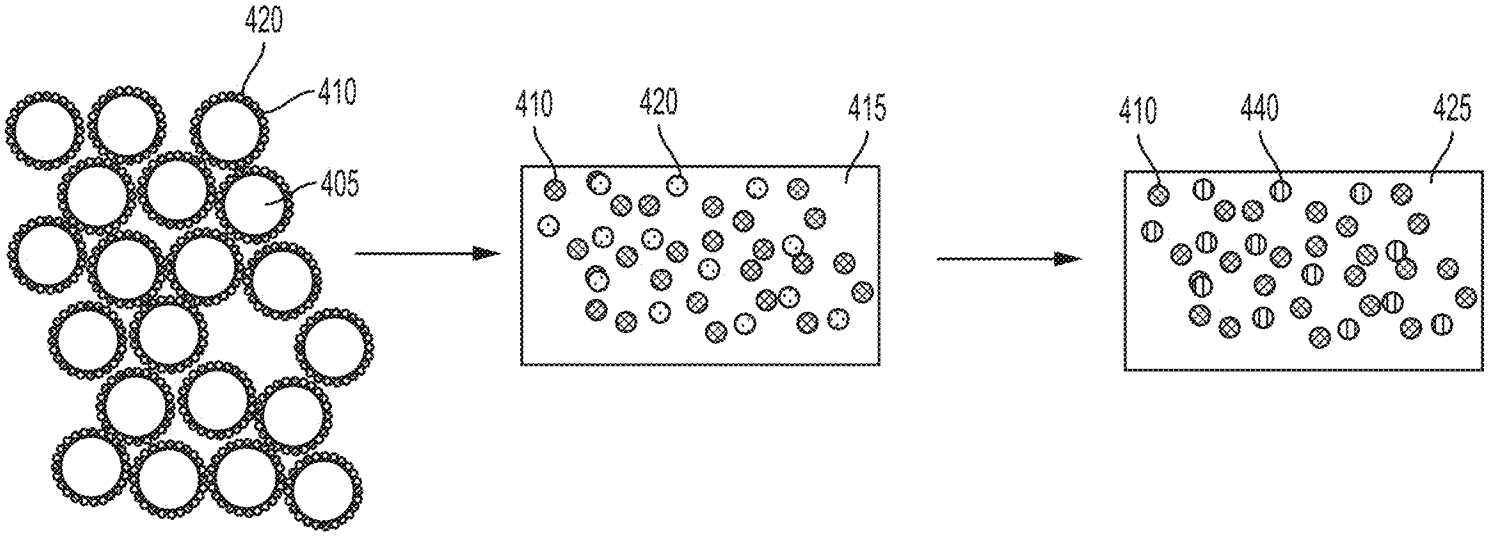
FIG. 4 depicts some embodiments starting with a functionalized powder containing metal microparticles coated with two types of nanoparticles, which are differently chemically and/or physically, and then one of the nanoparticles reacts while the other does not within the metal phase.

FIG. 4 depicts some embodiments starting with a functionalized powder containing metal microparticles 405 coated with nanoparticles 410 and 420, which are different chemically and/or physically. Heat is applied and the functionalized powder is converted to an ingot (or other material) containing nanoparticles 410 and 420 distributed in metal phase 415. Then heat and/or pressure are applied and nanoparticles 420 react to become nanoparticles 440 in a new phase, while nanoparticles 410 do not react and are distributed as nanoparticles 410 in the metal phase 425.

FIG. 4 also illustrates that reinforcement phases may be created by in-situ chemical reactions with matrix constituents, instead of (or in addition to) ex-situ methods. In ex-situ methods, reinforcements are synthesized externally and then added into the matrix during composite fabrication.

Functionally Graded Metal Matrix Nanocomposites

This invention in some variations provides a functionally graded metal matrix nanocomposite and a method for its fabrication. As intended herein, a "functionally graded metal matrix nanocomposite" is a metal matrix nanocomposite that exhibits a spatial gradient of one or more properties, derived from some spatial variation, within the metal matrix, of a nanoparticle or nanoparticle phase. The property that varies may be mechanical, thermal, electrical, photonic, magnetic, or any other type of functional property. Some variations provide a functionally graded metal matrix nanocomposite produced by a density-driven separation (concentration or depletion) of the reinforcing particulate.

Metal matrix composites are typically fabricated with a micrometer-size reinforcing particulate homogeneously dispersed in a metal matrix. In order to achieve larger amounts of strengthening, reducing the size of the reinforcement particulate to the nanoscale is preferred. However, reinforcement phase reactivity and inability to completely disperse hard phases at the nanoscale in melt processing limit production opportunities of metal matrix nanocomposites.

Functionally graded metal matrix nanocomposite are conventionally even more difficult to process and are limited to friction stir processing which is geometrically and compositionally limited. Using metal feedstock with nanoparticle functionalization as a means of mitigating reactivity and dispersion issues in melt processing, functionally graded metal matrix nanocomposites can be produced with geometrically complex shapes and a broad spectrum of compositions. Known melt-processing techniques such as centrifugal casting, gravity casting, or electromagnetic separation casting may be employed to fabricate the functionally graded metal matrix nanocomposites.

Melt processing of metal matrix nanocomposites has traditionally proven to be difficult in part due to particulate instability in the molten matrix and an inability to fully disperse the nanoparticles due to surface energies. By contrast, in some embodiments of the present invention, reaction times in the liquid are reduced by utilizing a pre-dispersed metal matrix nanocomposite feedstock powder, wherein nanoparticles are consolidated in a three-dimensional architecture throughout the feedstock powder.

Density-driven phase separation may then be carried out to selectively segregate a first phase comprising the metal matrix and a second phase comprising the nanoparticles. The segregation of the nanoparticles and the metal matrix is useful because the nanoparticles are then selectively contained in a solid reinforcement phase that has enhanced properties compared to the metal matrix phase. The density-driven phase separation may result in a higher concentration or a lower concentration (i.e., depletion) of nanoparticles in any particular phase. The first phase may be in liquid form or a liquid-solid solution, while the nanoparticles typically remain solid or at least as a distinct material phase in the melt. Subsequent solidification of the melt produces a graded density of nanoparticles within the solid metal matrix nanocomposite.

Various forces may be employed to segregate nanoparticles by density, such as centrifugal, gravitational, thermal, electrical, acoustic, or other forces. Density-driven segregation may be accelerated by the application of an external force. Notably, density-driven phase separation can be used with metals that are not compatible with friction stir processing.

The nanoparticle concentration may vary in volume fraction across the bulk of the material from 0 to 1.0, such as about 0.05, 0.1, 0.2, 0.3, 0.4, 0.5, 0.6, 0.7, 0.8, 0.9, or 0.95. The local nanoparticle concentrations (volume fractions) will depend on the starting amount of nanoparticles (on microparticle surfaces), the properties of the metal matrix, and the segregation technique employed. Following segregation, the region enriched in nanoparticles may have a volume fraction up to 1.0, i.e. only nanoparticles in that phase. Similarly, the region depleted in nanoparticles may have a volume fraction of 0, i.e. no nanoparticles in that phase. The transition between low and high nanoparticle concentrations may be a gradual gradient (e.g., FIG. 5) or a sharp gradient (e.g., FIG. 12).

In addition to gradients in concentration, there can also be gradients in particle sizes and material phases present, for example. When density-driven segregation is used, there will of course also be a density gradient. The difference between nanoparticle density and metal matrix density may be at least 0.1, 0.5, 1, 2, 5, 10, or 15 g/cm$^3$, for example. The difference is about 13 g/cm$^3$ in Example 1.

When density-driven segregation is used, depending on the density differences, various length scales of gradients are possible. For example when the density difference is very large, nanoparticles may form a high concentration in one region or layer of the material. The gradient may be present over a length scale from about 10 microns to about 1 centimeter or more, for example. In preferred embodiments, the gradient length scale is at least 100 microns.

Nanocomposites are often strong but may sometimes lack toughness, which can be problematic at high nanoparticle loading. By incorporating functional grading, the material properties such as toughness can be maintained while providing enhanced surface properties, enhanced bulk properties, or enhanced overall properties. For example, a functionally graded metal matrix nanocomposite may be designed to have high-hardness surfaces which improve wear characteristics, in comparison to metal matrix composites reinforced with micrometer reinforcement. The improved wear characteristics arise from the enhanced strengthening mechanisms introduced at the nanoscale, as a result of a higher concentration of nanoparticles at or near the surface.

In some embodiments, an ingot is made or obtained, for later producing a metal matrix nanocomposite. An "ingot" or equivalently "pre-dispersed ingot" means a raw material that contains both a metal component and a pre-dispersed reinforcing nanoparticle component. An ingot may be obtained after processing of a functionalized powder, or after processing of a metal matrix nanocomposite. In some embodiments, the ingot already contains a functional gradient of nanoparticle density. In some embodiments, the ingot has or contains a microstructure indicative of a material which consisted of powder precursors with nanoparticle surface functionalization. This will result in a 3D network of nanoparticles in the ingot.

An ingot may be a green body or a finished body. Ingot relative densities may range from 10% to 100%, for example, calculated as a percentage of the theoretical density (void-free) of the components contained in the ingot.

The use of the ingot may vary. Further processing may result in the redistribution of nanoparticles throughout the structure. The ingot may be processed in such a way that it has the distinct advantage of containing a targeted volume fraction of nanoparticles determined during functionalization and a uniform distribution due to the discrete nanoparticle assembly on the surface of the metal-containing microparticles.

Some variations of the invention provide a functionally graded metal matrix nanocomposite comprising a metal-matrix phase and a first reinforcement phase containing first nanoparticles, wherein the nanocomposite contains a gradient in concentration of the first nanoparticles through at least one dimension of the nanocomposite. The gradient in concentration of the nanoparticles particles may be present in the nanocomposite over a length scale of at least 100 microns. The nanocomposite has a cast microstructure, in some embodiments.

The metal-matrix phase may contain an element selected from the group consisting of Al, Mg, Ni, Fe, Cu, Ti, V, Si, and combinations thereof. The first nanoparticles may contain a compound selected from the group consisting of metals, ceramics, cermets, intermetallic alloys, oxides, carbides, nitrides, borides, polymers, carbon, and combinations thereof. In some embodiments, the metal-matrix phase contains Al, Si, and Mg, and the first nanoparticles contain tungsten carbide (WC).

The first nanoparticles may have an average particle size from about 1 nanometer to about 1000 nanometers, such as about 10, 50, 100, 200, 300, 400, 500, 600, 700, 800, or 900 nanometers. Some or all of the first nanoparticles may be agglomerated such that the effective particle size in the nanoparticle phase is larger than 1000 nanometers, in some embodiments.

The nanocomposite may contain from about 10 wt % to about 99.9 wt % of the metal-matrix phase, such as about 20, 30, 40, 50, 60, 70, 80, or 90 wt %, for example.

The nanocomposite may contain from about 0.1 wt % to about 50 wt % of the first nanoparticles, such as about 1, 5, 10, 20, 30, or 40 wt %, for example.

In some embodiments, the nanocomposite further comprises second nanoparticles in the first reinforcement phase and/or in a second reinforcement phase.

In some embodiments, the metal-matrix phase and the first reinforcement phase are each dispersed throughout the nanocomposite. In these or other embodiments, the metal-matrix phase and the first reinforcement phase are disposed in a layered configuration within the nanocomposite, wherein the layered configuration includes at least a first layer comprising the first nanoparticles and at least a second layer comprising the metal-matrix phase.

The nanocomposite may be present in an object or article that has at least one dimension of 100 microns or greater, such as 200 microns, 500 microns, 1 millimeter, 5 millimeters, 1 centimeter, or greater. Object or article sizes vary widely.

Certain variations of the invention provide a functionally graded metal matrix nanocomposite comprising a metal-matrix phase containing Al, Si, and Mg and a reinforcement phase containing W and C, wherein the nanocomposite contains a gradient in concentration of the reinforcement phase through at least one dimension of the nanocomposite. The nanocomposite may have a cast microstructure.

The metal-matrix phase contains aluminum alloy AlSi10Mg, in certain embodiments. AlSi10Mg is a typical casting alloy with good casting properties and is often used for cast parts with thin walls and complex geometry. It offers good strength, hardness, and dynamic properties and is therefore also used for parts subject to high loads. Adding a reinforcement phase to AlSi10Mg offers additional benefits to properties. The reinforcement phase contains tungsten carbide (WC), in certain embodiments.

In some embodiments, the metal-matrix phase and the reinforcement phase are disposed in a layered configuration within the nanocomposite, wherein the layered configuration includes a first layer comprising W, C, Al, Si, and Mg, and a second layer comprising Al, Si, and Mg—that is, the first layer is enriched in W and C, such as in the form of WC nanoparticles.

In some embodiments, the nanocomposite is a master alloy, as further discussed below.

Other variations provide a method of making a functionally graded metal matrix nanocomposite, the method comprising:

(a) providing a precursor composition (e.g., powder) comprising metal-containing microparticles and nanoparticles, wherein the nanoparticles are chemically and/or physically disposed on surfaces of the microparticles;

(b) consolidating the precursor composition into an intermediate composition (e.g., ingot) comprising the metal-containing microparticles and the nanoparticles, wherein the nanoparticles are consolidated in a three-dimensional architecture throughout the intermediate composition;

(c) melting the intermediate composition to form a melt, wherein the melt segregates into a first phase comprising the metal-containing microparticles and a second phase comprising, or obtained from, the nanoparticles; and (d) solidifying the melt to obtain a metal matrix nanocomposite with a gradient in concentration of the nanoparticles through at least one dimension of the nanocomposite.

The microparticles may contain an element selected from the group consisting of Al, Mg, Ni, Fe, Cu, Ti, V, Si, and combinations thereof. The nanoparticles may contain a compound selected from the group consisting of metals, ceramics, cermets, intermetallic alloys, oxides, carbides, nitrides, borides, polymers, carbon, and combinations thereof. In some embodiments, the microparticles contain Al, Si, and Mg, and the nanoparticles contain tungsten carbide (WC).

In various embodiments, step (b) includes pressing, binding, sintering, or a combination thereof.

In various embodiments, step (c) includes pressing, sintering, mixing, dispersing, friction stir welding, extrusion, binding, melting, semi-solid melting, capacitive discharge sintering, casting, or a combination thereof. Step (c) may also include holding the melt for an effective dwell time to cause density-driven segregation of the first phase from the second phase. The dwell time may be selected from about 1 minute to about 8 hours, for example. In some embodiments, step (c) includes exposing the melt to an external force selected from gravitational, centrifugal, mechanical, electromagnetic, or a combination thereof.

Step (d) may include directional solidification or progressive solidification of the melt. Directional solidification and progressive solidification are types of solidification within castings. Directional solidification is solidification that occurs from the farthest end of the casting and works its way towards the passage through which liquid material is introduced into a mold. Progressive solidification is solidification that starts at the walls of the casting and progresses perpendicularly from that surface.

The metal-matrix phase and the reinforcement phase may be each dispersed throughout the nanocomposite. In these or other embodiments, the metal-matrix phase and the reinforcement phase are disposed in a layered configuration within the nanocomposite, wherein the layered configuration includes at least a first layer comprising the nanoparticles and at least a second layer comprising the metal-matrix phase. The nanoparticles may undergo some amount of agglomeration. Agglomeration between nanoparticles may result in nanoparticles being chemically or physically bound together. Individual nanoparticles may or may not be present or detectable in the reinforcement phase, and the length scale associated with the nanoparticles may become greater than 1000 nm.

The gradient in concentration of the nanoparticles may be present in the nanocomposite over a length scale of at least 10 microns, such as at least 100 microns, up to about 1 centimeter or more, for example.

In some embodiments, the functionally graded metal matrix nanocomposite has a cast microstructure, defined above. In certain embodiments, there is a functional gradient in the microstructure itself, related to or independent of the concentration gradient.

FIGS. 5 to 10 exhibit various embodiments of functionally graded metal matrix nanocomposites.

Figure 5:
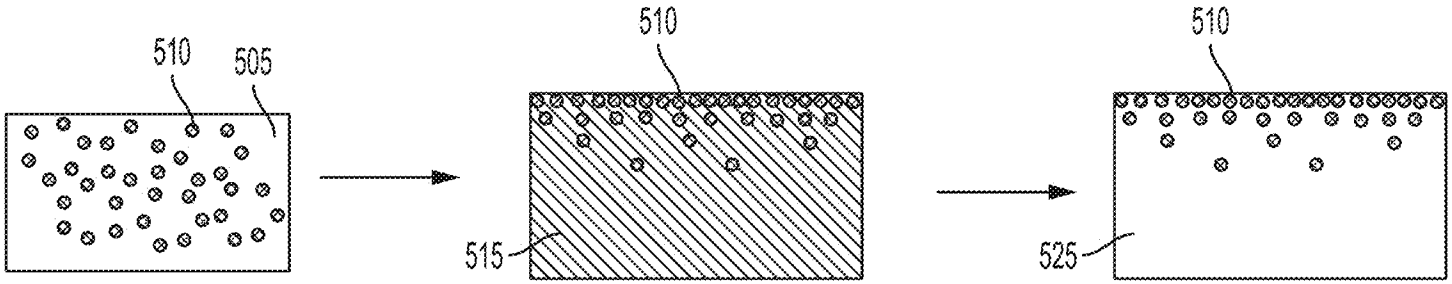
FIG. 5 depicts some embodiments starting with nanoparticles predistributed in a metal matrix, such as in an ingot, with density-driven phase segregation in which nanoparticles migrate toward the surface, followed by solidification, resulting in a functionally graded metal matrix nanocomposite.

FIG. 5 depicts some embodiments starting with nanoparticles 510 predistributed in a metal matrix 505, such as in an ingot. The ingot may be obtained from heating a functionalized powder containing metal microparticles coated with nanoparticles, as shown in FIGS. 1-4. Heat is applied to the ingot which undergoes density-driven phase segregation in which nanoparticles 510 migrate toward the surface (against gravity) due to a density less than the density of the molten matrix 515. After solidification, the resulting functionally graded metal matrix nanocomposite contains a higher concentration of nanoparticles 510 at or near the surface, compared to the bulk of the material, within the metal phase 525.

Figure 6:
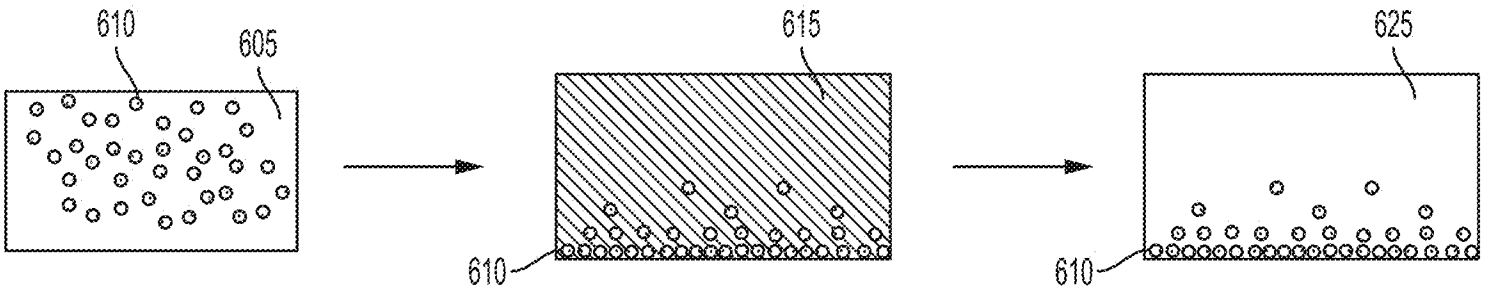
FIG. 6 depicts some embodiments starting with nanoparticles predistributed in a metal matrix, such as in an ingot, with density-driven phase segregation in which nanoparticles migrate away from the surface, followed by solidification, resulting in a functionally graded metal matrix nanocomposite.

FIG. 6 depicts some embodiments starting with nanoparticles 610 predistributed in a metal matrix 605, such as in an ingot. The ingot may be obtained from heating a functionalized powder containing metal microparticles coated with nanoparticles, as shown in FIGS. 1-4. Heat is applied to the ingot which undergoes density-driven phase segregation in which nanoparticles 610 migrate away from the surface (in the direction of gravity) due to a density greater than the density of the molten matrix 615. After solidification, the resulting functionally graded metal matrix nanocomposite contains a higher concentration of nanoparticles 610 at or near the distal region away from the surface, compared to the bulk of the material, within the metal phase 625.

Figure 7:
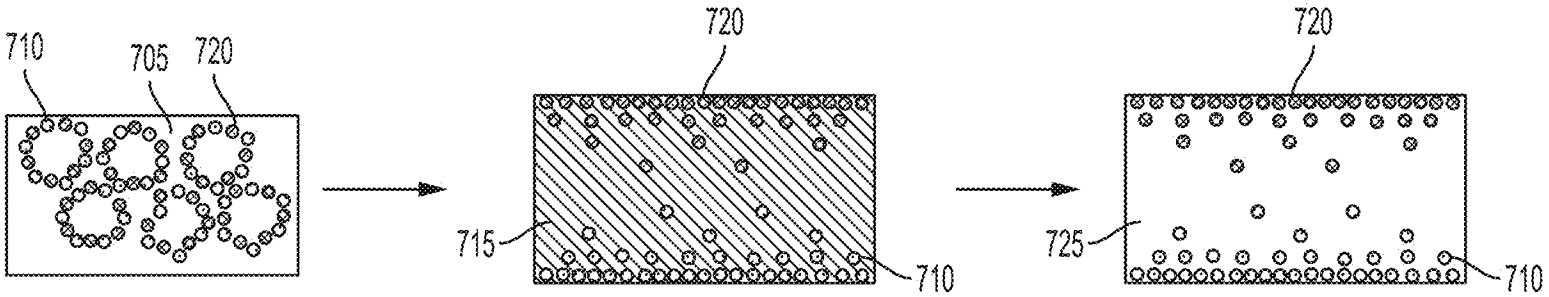
FIG. 7 depicts some embodiments starting with codispersed nanoparticles predistributed in a metal matrix, such as in an ingot, with density-driven phase segregation in which some nanoparticles migrate away from the surface while other nanoparticles migrate toward the surface, followed by solidification, resulting in a functionally graded metal matrix nanocomposite.

FIG. 7 depicts some embodiments starting with codispersed nanoparticles 710 and 720 predistributed in a metal matrix 705, such as in an ingot. The ingot may be obtained from heating a functionalized powder containing metal microparticles coated with nanoparticles, as shown in FIGS. 1-4. Heat is applied to the ingot which undergoes density-driven phase segregation in which nanoparticles 710 migrate away from the surface (in the direction of gravity) due to a density greater than the density of the molten matrix 715, while nanoparticles 720 migrate toward the surface (against gravity) due to a density less than the density of the molten matrix 715. After solidification, the resulting functionally graded metal matrix nanocomposite contains a higher concentration of nanoparticles 710 at or near the distal region away from the surface, and a higher concentration of nanoparticles 720 at or near the surface, compared to the bulk of the material, within the metal phase 725.

Figure 8:
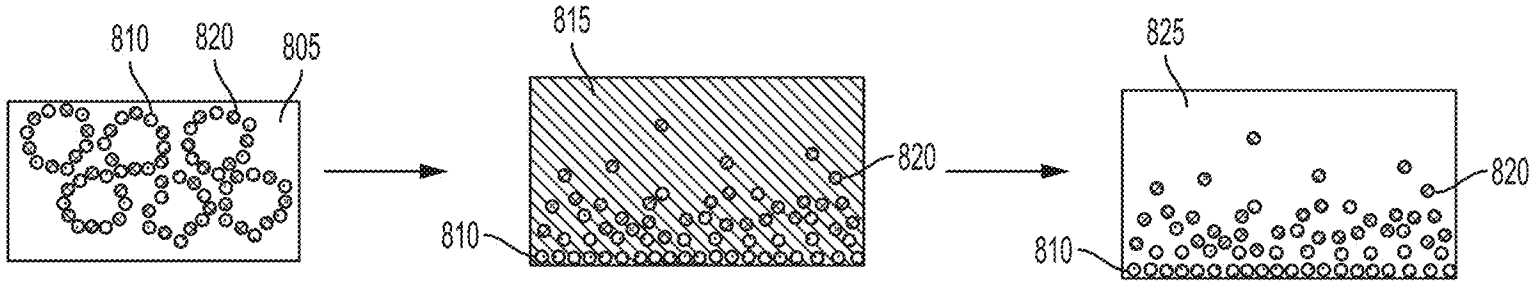
FIG. 8 depicts some embodiments starting with codispersed nanoparticles predistributed in a metal matrix, such as in an ingot, with density-driven phase segregation in which nanoparticles migrate away from the surface, followed by solidification, resulting in a functionally graded metal matrix nanocomposite.

FIG. 8 depicts some embodiments starting with codispersed nanoparticles 810 and 820 predistributed in a metal matrix 805, such as in an ingot. The ingot may be obtained from heating a functionalized powder containing metal microparticles coated with nanoparticles, as shown in FIGS. 1-4. Heat is applied to the ingot which undergoes density-driven phase segregation in which nanoparticles 810 migrate away from the surface (in the direction of gravity) due to a density greater than the density of the molten matrix 815. In this embodiment, nanoparticles 820 also migrate away from the surface (in the direction of gravity) due to a density greater than the density of the molten matrix 815, but the density of nanoparticles 820 is less than the density of nanoparticles 810. Therefore, nanoparticles 820 remain more dispersed within the molten metal matrix 815, compared to the nanoparticles 810. After solidification, the resulting functionally graded metal matrix nanocomposite contains a higher concentration of both nanoparticles 810 and 820 at or near the distal region away from the surface, compared to the bulk of the material, within the metal phase 825. The gradients of nanoparticles 810/820 concentrations are different.

Figure 9:
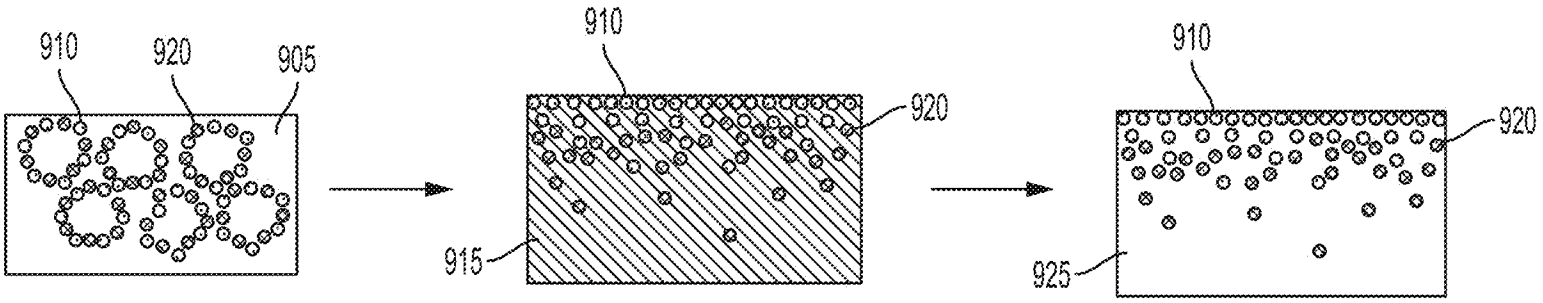
FIG. 9 depicts some embodiments starting with codispersed nanoparticles predistributed in a metal matrix, such as in an ingot, with density-driven phase segregation in which nanoparticles migrate toward the surface, followed by solidification, resulting in a functionally graded metal matrix nanocomposite.

FIG. 9 depicts some embodiments starting with codispersed nanoparticles 910 and 920 predistributed in a metal matrix 905, such as in an ingot. The ingot may be obtained from heating a functionalized powder containing metal microparticles coated with nanoparticles, as shown in FIGS. 1-4. Heat is applied to the ingot which undergoes density-driven phase segregation in which nanoparticles 910 migrate toward the surface (against gravity) due to a density less than the density of the molten matrix 915. In this embodiment, nanoparticles 920 also migrate toward the surface due to a density less than the density of the molten matrix 915, but the density of nanoparticles 920 is greater than the density of nanoparticles 930. Therefore, nanoparticles 920 are more dispersed within the molten metal matrix 915, compared to the nanoparticles 910. After solidification, the resulting functionally graded metal matrix nanocomposite contains a higher concentration of both nanoparticles 910 and 920 at or near the surface, compared to the bulk of the material, within the metal phase 925. The gradients of nanoparticles 910/920 concentrations are different.

FIG. 10 is an SEM image of a cross-section (side view) of an exemplary AlSi10Mg—WC functionally graded metal matrix nanocomposite, according to Example 1 (described in the EXAMPLES below).

Master Alloy Metal Matrix Nanocomposites

A "master alloy" is well-defined in the art and refers to a concentrated alloy source which can be added to a metal being processed, to introduce the appropriate alloying elements into the system. Master alloys are particularly useful when the alloying elements are difficult to disperse or in low weight quantities. In the case of the dispersion difficulties, pre-dispersed master alloys increase wetting and avoid agglomeration. In the case of low quantities, it is much easier to control additions when heavier weights of pre-alloyed material can be added, to avoid weighing errors for the minor alloying elements.

A "master alloy metal matrix nanocomposite" or equivalently "master alloy nanocomposite" herein means a metal matrix nanocomposite with greater than 0.1 wt % nanoparticles distributed in a metal or metal alloy matrix, suitable for further processing through a variety of different routes (melt processing, machining, forging, etc.) into a final product. The concentration of nanoparticles is typically at least 1 wt %.

In some variations of the invention, a functionally graded metal matrix nanocomposite is fabricated, followed by removal of one or more phases not containing nanoparticles from the nanocomposite, to generate a master alloy metal matrix nanocomposite.

The production of a master alloy metal matrix nanocomposite allows for a high volume loading of reinforcement phases into metal matrices. By consolidating a homogenously dispersed nanoparticle reinforcement phase, such as via density-driven phase separation, and then removing a portion that does not contain the nanoparticle reinforcement phase, a master alloy is obtained. The master alloy may be used in further processing to produce a final geometrical configuration, such as in melt processing and casting.

These methods provide low-cost, high-volume production of master alloy metal matrix nanocomposites with high volume loading of nanoparticulate reinforcement. Reaction times may be minimized by using a pre-dispersed metal matrix nanocomposite feedstock powder or feedstock ingot.

Some variations of the invention provide a method of making a master alloy metal matrix nanocomposite, the method comprising:

(a) providing an ingot composition comprising metal-containing microparticles and nanoparticles, wherein the nanoparticles are chemically and/or physically disposed on surfaces of the microparticles, and wherein the nanoparticles are consolidated in a three-dimensional architecture throughout the ingot composition;

(b) melting the ingot composition to form a melt, wherein the melt segregates into a first phase comprising the metal-containing microparticles and a second phase comprising the nanoparticles;

(c) solidifying the melt to obtain a metal matrix nanocomposite with a gradient in concentration of the nanoparticles through at least one dimension of the nanocomposite; and (d) removing a fraction of the metal matrix nanocomposite containing a lower concentration of the nanoparticles compared to the remainder of the metal matrix nanocomposite, thereby producing a master alloy metal matrix nanocomposite.

The microparticles may contain an element selected from the group consisting of Al, Mg, Ni, Fe, Cu, Ti, V, Si, and combinations thereof. The nanoparticles may contain a compound selected from the group consisting of metals, ceramics, cermets, intermetallic alloys, oxides, carbides, nitrides, borides, polymers, carbon, and combinations thereof. In certain embodiments, the microparticles contain Al, Si, and Mg, and the nanoparticles contain tungsten carbide (WC).

The processing in steps (b) and (c) takes a pre-dispersed ingot, or other starting ingot composition, as a raw material and produces a functionally graded metal matrix nanocomposite.

Step (b) may further include pressing, sintering, mixing, dispersing, friction stir welding, extrusion, binding, capacitive discharge sintering, casting, or a combination thereof. Step (b) may include holding the melt for an effective dwell time (e.g., about 1 minute to 8 hours) to cause density-driven segregation of the first phase from the second phase. Optionally, step (b) may include exposing the melt to an external force selected from gravitational, centrifugal, mechanical, electromagnetic, or a combination thereof.

Step (c) may include directional solidification or progressive solidification of the melt, if desired. Directional solidification is solidification that occurs from the farthest end of the casting and works its way towards the passage through which liquid material is introduced into a mold. Progressive solidification is solidification that starts at the walls of the casting and progresses perpendicularly from that surface.

The gradient in concentration of the first nanoparticles may be present in the metal matrix nanocomposite over a length scale of at least 100 microns.

In some embodiments, the metal-matrix phase and the first reinforcement phase are each dispersed throughout the metal matrix nanocomposite. In these or other embodiments, the metal-matrix phase and the first reinforcement phase are disposed in a layered configuration within the metal matrix nanocomposite, wherein the layered configuration includes at least a first layer comprising the nanoparticles and at least a second layer comprising the metal-matrix phase.

Step (d) may include includes machining, ablation, reaction, dissolution, evaporation, selective melting, or a combination thereof. In certain embodiments, step (d) provides two distinct master alloy metal matrix nanocomposites. A number of heating methods and dwell times are appropriate for the production of density-driven master alloy metal matrix nanocomposites.

In some embodiments, a method of fabrication of a master alloy metal matrix nanocomposite starts by using a pre-dispersed ingot as a raw material with a metal component and a reinforcing particulate. This ingot is taken to a liquid or a semi-solid phase through processing, wherein the metal component enters a molten liquid or semi-solid phase with a dispersed reinforcing component (nanoparticles).

The reinforcing component segregates through density-driven segregation, in some embodiments. In particular, the matrix is solidified and the reinforcing component is separated by density into one or more higher-volume fractions (compared to the matrix). The low-volume fraction component of the whole solid is then removed, at least partially, to leave behind a final product of a high-volume fraction master alloy metal matrix nanocomposite.

Compositions of this master alloy vary widely, according to selection of the matrix metal(s) or metal alloy(s) in combination with nanoparticles of arbitrary composition, including other metals or metal alloys. Reinforcing nanoparticles are preferably less than 1000 nm in size, more preferably less than 250 nm, with any geometrical configuration (rod, sphere, prism, etc.). Note that the removed low-density material may be recycled and used in subsequent processing. By producing a master alloy which may be added to a targeted alloy system in the molten state, fully dispersed metal matrix nanocomposites may be created and later processed under conventional, cost-effective pyro-metallurgy approaches.

In some embodiments, the metal matrix nanocomposite in step (c) is characterized by a cast microstructure. The final master alloy metal matrix nanocomposite(s) may have a cast microstructure. A cast microstructure is characterized in that it includes a plurality of dendrites (from crystal growth) and grain boundaries within the microstructure. In some embodiments, there is also a plurality of voids, but preferably no cracks or large phase boundaries.

In some embodiments, a cast microstructure is further characterized by an equiaxed, fine-grained microstructure. Equiaxed grains are roughly equal in length, width, and height. Equiaxed grains can result when there are many nucleation sites arising from the plurality of nanoparticles contained on surfaces of microparticles, in the functionalized metal feedstock and therefore in the master alloy metal matrix nanocomposite.

In some embodiments, a cast microstructure is further characterized by a dispersed microstructure. A dispersed microstructure generally arises from the large number of dendrites and grain boundaries within the microstructure, which in turn arise from the large number of nanoparticles initially on surfaces of microparticles. The degree of dispersion may be characterized by a dispersion length scale, calculated as the average spacing between nanoparticles and/or the average length scale in the metal phase between nanoparticles. In various embodiments, the dispersion length scale is from about 1 nanometer to about 100 microns, such as from about 10 nanometers to about 10 microns, or about 100 nanometers to about 1 micron.

Optionally, porosity may be removed or reduced in a cast microstructure. For example, a secondary heat and/or pressure (or other mechanical force) treatment may be done to minimize porous voids present in the metal matrix nanocomposite. Also, pores may be removed from the metal matrix nanocomposite by physically removing (e.g., cutting away) a region into which porous voids have segregated, such as via density-driven phase segregation. The desired master alloy may have fewer voids, or no voids, compared to the region removed.

In addition to removal of voids, other post-working may be carried out, potentially resulting in other final microstructures that are not cast microstructures, or that contain a mixture of microstructures. For example, forging can refine defects from cast ingots or continuous cast bar, and can introduce additional directional strength, if desired. Pre-working (e.g., strain hardening) can be done such as to produce a grain flow oriented in directions requiring maximum strength. The master alloy microstructure therefore may be a forged microstructure, or a mixed cast/forged microstructure, in certain embodiments. In various embodiments, the master alloy metal matrix microstructure, on a volume basis, is at least 10%, 25%, 50%, 75%, 90%, 95%, 99%, or 100% cast microstructure.

The master alloy may ultimately be processed in various parts. These parts may be produced by a variety of processes, and therefore a final part may or may not have a cast microstructure. Metal-part forming operations include, but are not limited to, forging, rolling, extrusion, drawing, sand casting, die casting, investment casting, powder metallurgy, welding, additive manufacturing, or others. A cast microstructure may be desired in the final part, or a different microstructure may be desired, such as a forged microstructure. A cast microstructure for the master alloy may be preferred for the performance and quality of a final part, in some embodiments.

FIGS. 11 to 15 exhibit several, non-limiting embodiments of master alloy metal matrix nanocomposites.

FIG. 11 is an SEM image of a cross-section (side view) of an exemplary AlSi10Mg—WC master alloy metal matrix nanocomposite, according to Example 2 (described in the EXAMPLES below).

Figure 12:
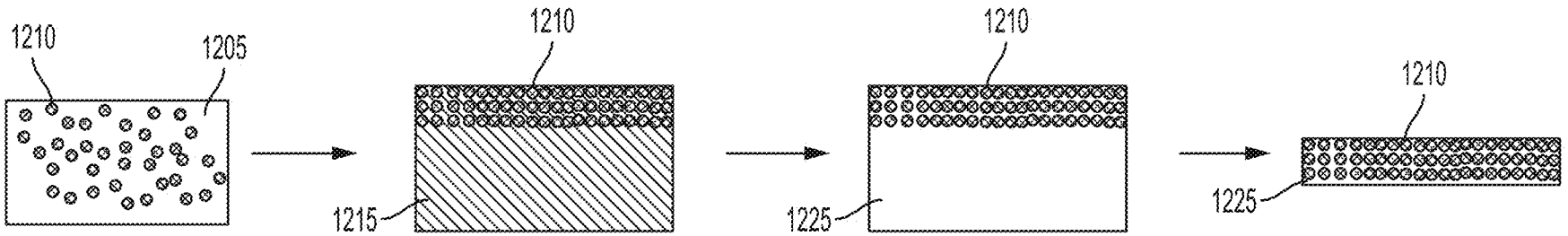
FIG. 12 depicts some embodiments to produce a master alloy metal matrix nanocomposite enriched with nanoparticles in a metal matrix, by first producing a functionally graded metal matrix nanocomposite and then removing a phase of material containing a relatively low volume fraction of nanoparticles.

FIG. 12 depicts some embodiments starting with nanoparticles 1210 predistributed in a metal matrix 1205, such as in an ingot. Heat is applied to the ingot undergoes density-driven phase segregation in which nanoparticles 1210 migrate toward the surface (against gravity) due to a density less than the density of the molten matrix 1215. After solidification, the resulting functionally graded metal matrix nanocomposite contains a higher concentration of nanoparticles 1210 at or near the surface, compared to the bulk of the material, within the metal phase 1225. A portion of the solid 1225, with relatively lower concentration of nanoparticles 1210 (or no nanoparticles as in this illustration), is then removed. The result is a master alloy metal matrix nanocomposite enriched with nanoparticles 1210 in metal matrix 1225.

Figure 13:
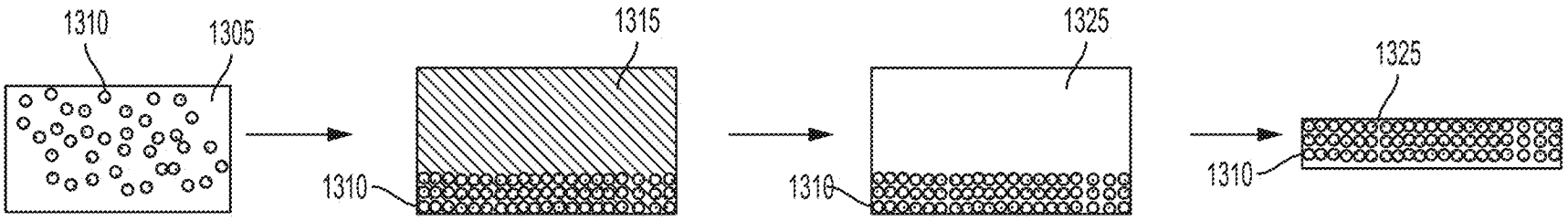
FIG. 13 depicts some embodiments to produce a master alloy metal matrix nanocomposite enriched with nanoparticles in a metal matrix, by first producing a functionally graded metal matrix nanocomposite and then removing a phase of material containing a relatively low volume fraction of nanoparticles.

FIG. 13 depicts some embodiments starting with nanoparticles 1310 predistributed in a metal matrix 1305, such as in an ingot. Heat is applied to the ingot which undergoes density-driven phase segregation in which nanoparticles 1310 migrate away from the surface (in the direction of gravity) due to a density greater than the density of the molten matrix 1315. After solidification, the resulting functionally graded metal matrix nanocomposite contains a higher concentration of nanoparticles 1310 at or near the distal region away from the surface, compared to the bulk of the material, within the metal phase 1325. A portion of the solid 1325, with relatively lower concentration of nanoparticles 1310 (or no nanoparticles as in this illustration), is then removed. The result is a master alloy metal matrix nanocomposite enriched with nanoparticles 1310 in metal matrix 1325.

Figure 14:
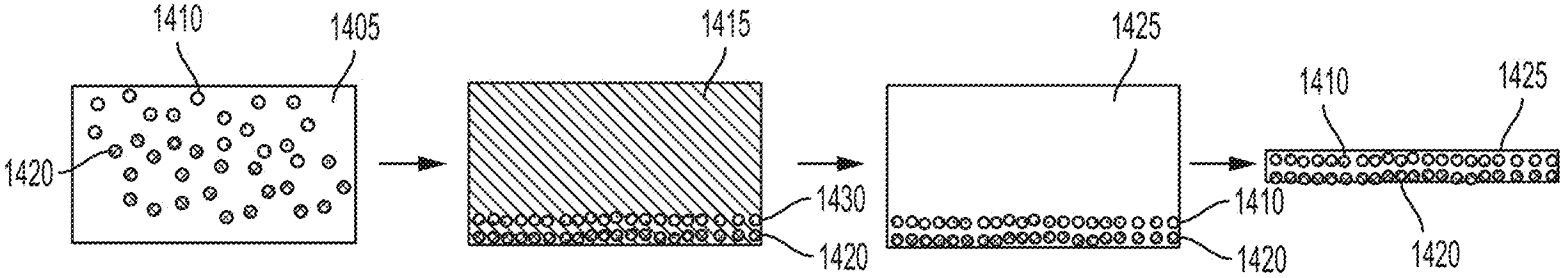
FIG. 14 depicts some embodiments to produce a master alloy metal matrix nanocomposite enriched with two types of nanoparticles in a metal matrix, by first producing a functionally graded metal matrix nanocomposite and then removing a phase of material containing a relatively low volume fraction of both types of nanoparticles.

FIG. 14 depicts some embodiments starting with codispersed nanoparticles 1410 and 1420 predistributed in a metal matrix 1405, such as in an ingot. Heat is applied to the ingot which undergoes density-driven phase segregation in which nanoparticles 1410 migrate away from the surface (in the direction of gravity) due to a density greater than the density of the molten matrix 1415. In this embodiment, nanoparticles 1420 also migrate away from the surface (in the direction of gravity) due to a density greater than the density of the molten matrix 1415, but the density of nanoparticles 1420 is greater than the density of nanoparticles 1410. After solidification, the resulting functionally graded metal matrix nanocomposite contains a higher concentration of both nanoparticles 1410 and 1420 at or near the distal region away from the surface, compared to the bulk of the material, within the metal phase 1425. A portion of the solid 1425, with relatively lower concentration of nanoparticles 1410/1420 (or no nanoparticles as in this illustration), is then removed. The result is a master alloy metal matrix nanocomposite enriched with nanoparticles 1410 and 1420 in metal matrix 1425. Note that the layered configuration in FIG. 14 is possible because the densities of nanoparticles 1410 and 1420 are different. In other embodiments, when the densities are the same or similar, nanoparticles 1410 and 1420 will tend to be uniformly dispersed within the final master alloy metal matrix nanocomposite.

Figure 15:
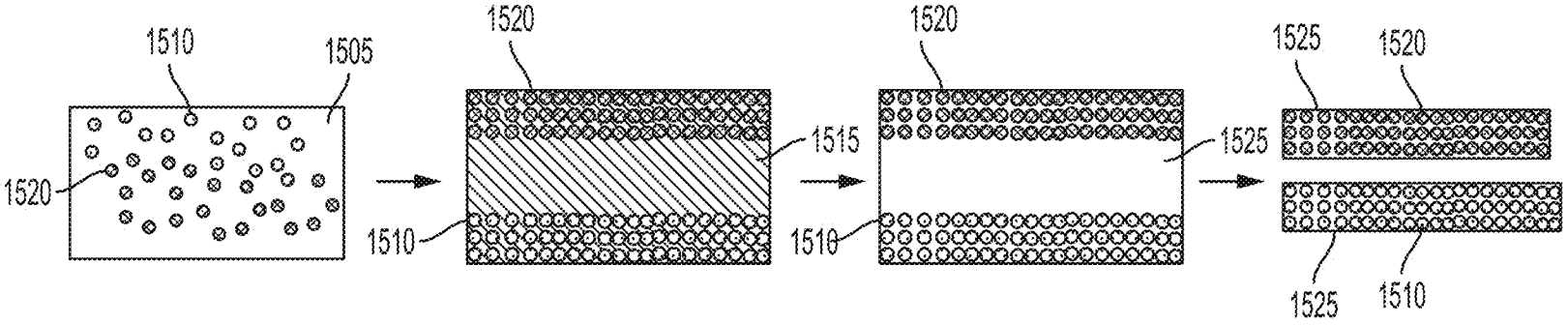
FIG. 15 depicts some embodiments to produce two distinct master alloy metal matrix nanocomposites enriched with different types of nanoparticles in a metal matrix, by first producing a functionally graded metal matrix nanocomposite and then removing a phase of material containing a relatively low volume fraction of both types of nanoparticles.

FIG. 15 depicts some embodiments starting with codispersed nanoparticles 1510 and 1520 predistributed in a metal matrix 1505, such as in an ingot. Heat is applied to the ingot which undergoes density-driven phase segregation in which nanoparticles 1510 migrate away from the surface (in the direction of gravity) due to a density greater than the density of the molten matrix 1515, while nanoparticles 1520 migrate toward the surface (against gravity) due to a density less than the density of the molten matrix 1515. After solidification, the resulting functionally graded metal matrix nanocomposite contains a higher concentration of nanoparticles 1510 at or near the distal region away from the surface, and a higher concentration of nanoparticles 1520 at or near the surface, compared to the bulk of the material, within the metal phase 1525. A portion of the solid 1525, with relatively lower concentration of nanoparticles 1510/1520 (or no nanoparticles as in this illustration), is then removed. Two distinct master alloy metal matrix nanocomposites are fabricated simultaneously. One master alloy metal matrix nanocomposite is enriched with nanoparticles 1510 in metal matrix 1525. The other master alloy metal matrix nanocomposite is enriched with nanoparticles 1520 in metal matrix 1525.

Functionalized Metal Feedstocks for Producing Metal Matrix Nanocomposites

Powder materials are a general class of feedstock for a powder metallurgy process, including but not limited to additive manufacturing, injection molding, and press and sintered applications. As intended herein, "powder materials" refers to any powdered ceramic, metal, polymer, glass, or composite or combination thereof. In some embodiments, the powder materials are metals or metal-containing compounds, but this disclosure should not be construed as limited to metal processing. Powder sizes are typically between about 1 micron and about 1 mm, but in some cases could be as much as about 1 cm.

The powdered material may be in any form in which discrete particles can be reasonably distinguished from the bulk. The powder materials are not always observed as loose powders and may be present as a paste, suspension, or green body. A green body is an object whose main constituent is weakly bound powder material, before it has been melted and solidified. For instance, a filler rod for welding may consist of the powder material compressed into a usable rod.

Particles may be solid, hollow, or a combination thereof. Particles can be made by any means including, for example, gas atomization, milling, cryomilling, wire explosion, laser ablation, electrical-discharge machining, or other techniques known in the art. The powder particles may be characterized by an average aspect ratio from about 1:1 to about 100:1. The "aspect ratio" means the ratio of particle length to width, expressed as length:width. A perfect sphere has an aspect ratio of 1:1. For a particle of arbitrary geometry, the length is taken to be the maximum effective diameter and the width is taken to be the minimum effective diameter.

In some embodiments, the particles are in the shape of rods. By "rod" it is meant a rod-shaped particle or domain shaped like long sticks, dowels, or needles. The average diameter of the rods may be selected from about 5 nanometers to about 100 microns, for example. Rods need not be perfect cylinders, i.e. the axis is not necessarily straight and the diameter is not necessarily a perfect circle. In the case of geometrically imperfect cylinders (i.e. not exactly a straight axis or a round diameter), the aspect ratio is the actual axial length, along its line of curvature, divided by the effective diameter, which is the diameter of a circle having the same area as the average cross-sectional area of the actual nanorod shape.

The powder material particles may be anisotropic. As meant herein, "anisotropic" particles have at least one chemical or physical property that is directionally dependent. When measured along different axes, an anisotropic particle will have some variation in a measurable property. The property may be physical (e.g., geometrical) or chemical in nature, or both. The property that varies along multiple axes may simply be the presence of mass; for example, a perfect sphere would be geometrically isotropic while a cylinder is geometrically anisotropic. The amount of variation of a chemical or physical property may be 5%, 10%, 20%, 30%, 40%, 50%, 75%, 100% or more.

"Solidification" generally refers to the phase change from a liquid to a solid. In some embodiments, solidification refers to a phase change within the entirety of the powder volume. In other embodiments, solidification refers to a phase change at the surface of the particles or within a fractional volume of the powder material. In various embodiments, at least (by volume) 1%, 2%, 5%, 10%, 15%, 20%, 25%, 30%, 40%, 50%, 60%, 70%, 80%, 90%, 95%, 99%, or 100% of the powdered material is melted to form the liquid state.

For a metal or mixtures of metals, solidification generally results in one or more solid metal phases that are typically crystalline, but sometimes amorphous. Ceramics also may undergo crystalline solidification or amorphous solidification. Metals and ceramics may form an amorphous region coinciding with a crystalline region (e.g., in semicrystalline materials). In the case of certain polymers and glasses, solidification may not result in a crystalline solidification. In the event of formation of an amorphous solid from a liquid, solidification refers to a transition of the liquid from above the glass-transition temperature to an amorphous solid at or below the glass-transition temperature. The glass-transition temperature is not always well-defined, and sometimes is characterized by a range of temperatures.

"Surface functionalization" refers to a surface modification on the powdered materials, which modification significantly affects the solidification behavior (e.g., solidification rate, yield, selectivity, heat release, etc.) of the powder materials. In various embodiments, a powdered material is functionalized with about 1%, 2%, 5%, 10%, 15%, 20%, 25%, 30%, 40%, 50%, 60%, 70%, 80%, 85%, 90%, 95%, 99%, or 100% of the surface area of the powdered material having the surface-functionalization modifications. The surface modification maybe a surface-chemistry modification, a physical surface modification, or a combination thereof.

In some embodiments, the surface functionalization includes a nanoparticle coating and/or a microparticle coating. The nanoparticles and/or microparticles may include a metal, ceramic, polymer, or carbon, or a composite or combination thereof. The surface functionalization may include a particle assembly that is chemically or physically disposed on the surface of the powder materials.

Due to the small size of nanoparticles and their reactivity, the benefits provided herein may be possible with less than 1% surface area coverage. In the case of functionalization with a nanoparticle of the same composition as the base powder, a surface-chemistry change may not be detectable and can be characterized by topological differences on the surface, for example. Functionalization with a nanoparticle of the same composition as the base powder may be useful to reduce the melting point in order to initiate sintering at a lower temperature, for example.

In some embodiments, microparticles coat micropowders or macropowders. The micropowder or macropowder particles may include ceramic, metal, polymer, glass, or combinations thereof. The microparticles (coating) may include metal, ceramic, polymer, carbon, or combinations thereof. In the case of microparticles coating other micropowders or macropowders, functionalization preferably means that the coating particles are of significantly different dimension(s) than the base powder. For example, the microparticles may be characterized by an average dimension (e.g., diameter) that is less than 20%, 10%, 5%, 2%, or 1% of the largest dimension of the coated powders.

In some embodiments, surface functionalization is in the form of a continuous coating or an intermittent coating. A continuous coating covers at least 90% of the surface, such as about 95%, 99%, or 100% of the surface (recognizing there may be defects, voids, or impurities at the surface). An intermittent coating is non-continuous and covers less than 90%, such as about 80%, 70%, 60%, 50%, 40%, 30%, 20%, 10%, 5%, 2%, 1%, or less of the surface. An intermittent coating may be uniform (e.g., having a certain repeating pattern on the surface) or non-uniform (e.g., random).

In general, the coating may be continuous or discontinuous. The coating may have several characteristic features. In one embodiment, the coating may be smooth and conformal to the underlying surface. In another embodiment, the coating may be nodular. The nodular growth is characteristic of kinetic limitations of nucleation and growth. For example, the coating may look like cauliflower or a small fractal growing from the surface. These features can be affected by the underling materials, the method of coating, reaction conditions, etc.

A coating may or may not be in the form of nanoparticles or microparticles. That is, the coating may be derived from nanoparticles or microparticles, while discrete nanoparticles or microparticles may no longer be present. Various coating techniques may be employed, such as (but not limited to) electroless deposition, immersion deposition, or solution coating. The coating thickness is preferably less than about 20% of the underlying particle diameter, such as less than 15%, 10%, 5%, 2%, or 1% of the underlying particle diameter.

In some embodiments, the surface functionalization also includes direct chemical or physical modification of the surface of the powder materials, such as to enhance the bonding of the nanoparticles or microparticles. Direct chemical modification of the surface of the powder materials, such as addition of molecules, may also be utilized to affect the solidification behavior of the powder materials. A plurality of surface modifications described herein may be used simultaneously.

Nanoparticles are particles with the largest dimension between about 1 nm and 1000 nm. A preferred size of nanoparticles is less than 250 nm, more preferably less than 100 nm. Microparticles are particles with the largest dimension between about 1 micron and 1000 microns. Nanoparticles or microparticles may be metal, ceramic, polymer, carbon-based, or composite particles, for example. The nanoparticle or microparticle size may be determined based on the desired properties and final function of the assembly.

Nanoparticles or microparticles may be spherical or of arbitrary shape with the largest dimension typically not exceeding the above largest dimensions. An exception is structures with extremely high aspect ratios, such as carbon nanotubes in which the dimensions may include up to 100 microns in length but less than 100 nm in diameter. The nanoparticles or microparticles may include a coating of one or more layers of a different material. Mixtures of nanoparticles and microparticles may be used. In some embodiments, microparticles themselves are coated with nanoparticles, and the microparticle/nanoparticle composite is incorporated as a coating or layer on the powder material particles.

Some variations provide a powdered material comprising a plurality of particles, wherein the particles are fabricated from a first material (e.g., ceramic, metal, polymer, glass, or combinations thereof), and wherein each of the particles has a particle surface area that is surface-functionalized (such as continuously or intermittently) with nanoparticles and/or microparticles selected to control solidification of the powdered material from a liquid state to a solid state. The nanoparticles and/or microparticles may include metal, ceramic, polymer, carbon, or combinations thereof.

In some embodiments, the powdered material is characterized in that on average at least 1%, 2%, 5%, 10%, 15%, 20%, 25%, 30%, 35%, 40%, 45%, 50%, or more of the particle surface area is surface-functionalized with the nanoparticles and/or the microparticles.

In some embodiments, the nanoparticles and/or microparticles are selected to control solidification of a portion of the powdered material, such as a region of powdered material for which solidification control is desired. Other regions containing conventional powdered materials, without nanoparticles and/or microparticles, may be present. In some embodiments, the nanoparticles and/or microparticles are selected to control solidification of a portion of each the particles (e.g., less than the entire volume of a particle, such as an outer shell).

Various material combinations are possible. In some embodiments, the powder particles are ceramic and the nanoparticles and/or microparticles are ceramic. In some embodiments, the powder particles are ceramic and the nanoparticles and/or microparticles are metallic. In some embodiments, the powder particles are polymeric and the nanoparticles and/or microparticles are metallic, ceramic, or carbon-based. In some embodiments, the powder particles are glass and the nanoparticles and/or microparticles are metallic. In some embodiments, the powder particles are glass and the nanoparticles and/or microparticles are ceramic. In some embodiments, the powder particles are ceramic or glass and the nanoparticles and/or microparticles are polymeric or carbon-based, and so on.

Exemplary ceramic materials for the powders, or the nanoparticles and/or microparticles, include (but are not limited to) SiC, HfC, TaC, ZrC, NbC, WC, TiC, $TiC_{0.7}N_{0.3}$, VC, $B_4C$, $TiB_2$, $HfB_2$, $TaB_2$, $ZrB_2$, $WB_2$, $NbB_2$, TaN, HfN, BN, ZrN, TiN, NbN, VN, $Si_3N_4$, $Al_2O_3$, $MgAl_2O_3$, $HfO_2$, $ZrO_2$, $Ta_2O_5$, $TiO_2$, $SiO_2$, and oxides of rare-earth elements Y, La, Ce, Pr, Nd, Sm, Eu, Gd, Tb, Dy, Ho Er, Tm, Yb, and/or Lu.

Exemplary metallic materials for the powders, or the nanoparticles and/or microparticles, include (but are not limited to) Sc, Ti, V, Cr, Y, Zr, Nb, Mo, Ru, Rh, Pd, La, Ce, Pr, Nd, Sm, Eu, Gd, Tb, Dy, Ho Er, Tm, Yb, Lu, Ta, W, Re, Os, Ir, Pt, Si, or B.

Exemplary polymer materials for the powders, or the nanoparticles and/or microparticles, include (but are not limited to) thermoplastic organic or inorganic polymers, or thermoset organic or inorganic polymers. Polymers may be natural or synthetic.

Exemplary glass materials for the powders include (but are not limited to) silicate glasses, porcelains, glassy carbon, polymer thermoplastics, metallic alloys, ionic liquids in a glassy state, ionic melts, and molecular liquids in a glassy state.

Exemplary carbon or carbon-based materials for the nanoparticles and/or microparticles include (but are not limited to) graphite, activated carbon, graphene, carbon fibers, carbon nanostructures (e.g., carbon nanotubes), and diamond (e.g., nanodiamonds).

These categories of materials are not mutually exclusive; for example a given material may be metallic/ceramic, a ceramic glass, a polymeric glass, etc.

The selection of the coating/powder composition will be dependent on the desired properties and should be considered on a case-by-case basis. Someone skilled in the art of material science or metallurgy will be able to select the appropriate materials for the intended process, based on the information provided in this disclosure. The processing and final product configuration should also be dependent on the desired properties. Someone skilled in the art of material science, metallurgy, and/or mechanical engineering will be able to select the appropriate processing conditions for the desired outcome, based on the information provided in this disclosure.

In some embodiments, a method of controlling solidification of a powdered material comprises:

providing a powdered material comprising a plurality of particles, wherein the particles are fabricated from a first material, and wherein each of the particles has a particle surface area that is surface-functionalized with nanoparticles and/or microparticles;

melting at least a portion of the powdered material to a liquid state; and semi-passively controlling solidification of the powdered material from the liquid state to a solid state.

As intended in this description, "semi-passive control," "semi-passively controlling," and like terminology refer to control of solidification during heating, cooling, or both heating and cooling of the surface-functionalized powder materials, wherein the solidification control is designed prior to melting through selected functionalization and is not actively controlled externally once the melt-solidification process has begun. Note that external interaction is not necessarily avoided. In some embodiments, semi-passive control of solidification further includes selecting the atmosphere (e.g., pressure, humidity, or gas composition), temperature, or thermal input or output. These factors as well as other factors known to someone skilled in the art may or may not be included in semi-passive control.

Exemplary semi-passive control processes, enabled through surface functionalization as described herein, will now be illustrated.

One route to control nucleation is the introduction, into the liquid phase, of nanoparticles derived from a coating described above. The nanoparticles may include any material composition described above and may be selected based on their ability to wet into the melt. Upon melt initiation, the nanoparticles wet into the melt pool as dispersed particles which, upon cooling, serve as nucleation sites, thereby producing a fine-grained structure with observable nucleation sites in the cross-section. In some embodiments, the density of nucleation sites is increased, which may increase the volumetric freezing rate due to the number of growing solidification fronts and the lack of a nucleation energy barrier.

In an exemplary embodiment, ceramic nanoparticles, e.g. $TiB_2$ or $Al_2O_3$ nanoparticles, are coated onto aluminum alloy microparticles. The ceramic nanoparticles are introduced into an aluminum alloy melt pool in an additive manufacturing process. The nanoparticles then disperse in the melt pool and act as nucleation sites for the solid. The additional well-dispersed nucleation sites can mitigate shrinkage cracks (hot cracking). Shrinkage cracks typically occur when liquid cannot reach certain regions due to blockage of narrow channels between solidifying grains. An increase in nucleation sites can prevent formation of long, narrow channels between solidifying grains, because multiple small grains are growing, instead of few large grains.

In another exemplary embodiment, nanoparticles act as nucleation sites for a secondary phase in an alloy. The nanoparticles may comprise the secondary phase or a material that nucleates the secondary phase (due to similar crystal structures, for instance). This embodiment can be beneficial if the secondary phase is responsible for blocking interdendritic channels leading to hot cracking. By nucleating many small grains of the secondary phase, a large grain that might block the narrow channel between the dendrites can be avoided. Furthermore, this embodiment can be beneficial if the secondary phase tends to form a continuous phase between the grains of the primary phase, which promotes stress corrosion cracking. By providing additional nucleation sites for the secondary phase, this secondary phase may be broken up and interdispersed, preventing it from forming a continuous phase between grains of the primary alloy. By breaking up a secondary phase during solidification, there is the potential to more completely homogenize the material during heat treatment, which can decrease the likelihood of stress corrosion cracking (fewer gradients in the homogenized material). If the secondary phase is not continuous, long notches from corrosion are less likely.

In another embodiment of nucleation control, the functionalized surface may fully or partially dissolve in the melt and undergo a reaction with materials in the melt to form precipitates or inclusions, which may act in the same manner as the nanoparticles in the preceding paragraph. For example, titanium particles may be coated on an aluminum alloy particle, which upon melting would dissolve the titanium. However, on cooling the material undergoes a peritectic reaction, forming aluminum-titanium intermetallic ($Al_3Ti$) inclusions which would serve as nucleation sites.

In another embodiment, the coating may react with impurities to form nucleation sites. An example is a magnesium coating on a titanium alloy powder. Titanium has a very high solubility of oxygen (a common atmospheric contaminant), which can affect the overall properties. A coating of magnesium reacts within the melt, binding to dissolved oxygen which forms magnesium oxide (MgO) inclusions, promoting nucleation.

Nucleation control may include the use of ceramic particles. In some embodiments, the ceramic particles can be wet by the molten material, while in other embodiments, the ceramic particles cannot be wet by the molten material. The ceramic particles may be miscible or immiscible with the molten state. The ceramic particles may be incorporated into the final solid material. In some embodiments, the ceramic particles are rejected from the solid. Exemplary ceramic materials include (but are not limited to) SiC, HfC, TaC, ZrC, NbC, WC, TiC, $TiC_{0.7}N_{0.3}$, VC, $B_4C$, $TiB_2$, $HfB_2$, $TaB_2$, $ZrB_2$, $WB_2$, $NbB_2$, TaN, HfN, BN, ZrN, TiN, NbN, VN, $Si_3N_4$, $Al_2O_3$, $MgAl_2O_3$, $HfO_2$, $ZrO_2$, $Ta_2O_5$, $TiO_2$, $SiO_2$, and oxides of rare-earth elements Y, La, Ce, Pr, Nd, Sm, Eu, Gd, Tb, Dy, Ho Er, Tm, Yb, and/or Lu.

Nucleation control may include the use of metallic particles. In some embodiments, the metallic particles can be wet by the molten material. The metallic particles may form an alloy with the molten material through a eutectic reaction or peritectic reaction. The alloy may be an intermetallic compound or a solid solution. In some embodiments, the metallic particles cannot be wet by the molten material and cannot form an alloy with the molten material. Exemplary metallic materials include (but are not limited to) Sc, Ti, V, Cr, Y, Zr, Nb, Mo, Ru, Rh, Pd, La, Ce, Pr, Nd, Sm, Eu, Gd, Tb, Dy, Ho Er, Tm, Yb, Lu, Ta, W, Re, Os, Ir, Pt, Si, or B.

Nucleation control may include the use of plastic particles. In some embodiments, the plastic particles can be wet by the molten material, while in other embodiments, the plastic particles cannot be wet by the molten material.

Nanoparticles promote surface growth of crystals that have good epitaxial fit. Nucleation on the surface of a nanoparticle is more likely when there is good fit between the crystal lattice parameters of the nanoparticles and the solidifying material. Nanoparticles may be selected to promote nucleation of a specific phase in the melt.

Generally, nucleation-promoting chemical reactions are dependent on the selected surface functionalization and on the heating (or cooling) parameters.

As nanoparticles or microparticles are organized on a particle surface under conditions for which rapid melting or near melting occurs and rapidly fuses the particles together with very little melt convection, the coating will not have the time or associated energy to diffuse away from its initial position relative to the other powders. This would in turn create a three-dimensional network structure of inclusions. Thus, a method is provided to control maximum grain size and/or to design a predictable microstructure. The microstructure is dependent on the initial powder size, shape, and packing configuration/density. Adjusting the coating and powder parameters allows control of this hierarchical structure. In some embodiments, these architectures significantly improve material properties by impeding, blocking, or redirecting dislocation motion in specific directions, thereby reducing or eliminating failure mechanisms.

Utilizing the appropriate functionalization, the heat flow during solidification may be controlled using heats of fusion or vaporization. In some embodiments, inclusions are pulled into the melt or reacted within the melt (as described above). In some embodiments, a coating is rejected to the surface of the melt pool. Utilizing a functionalization surface with a high vapor pressure at the desired melting point of the powder, vaporization would occur, resulting in a cooling effect in the melt which increases the freezing rate. As described above, magnesium on a titanium alloy may accomplish this, in addition to forming oxide inclusions. The effect of this is detectable when comparing non-functionalized powders to functionalized powders under identical conditions, as well as comparing the composition of feed material versus the composition of the final product.

In another embodiment, the opposite effect occurs. Some systems may require slower solidification times than can be reasonably provided in a certain production system. In this instance, a higher-melting-point material, which may for example be rejected to the surface, freezes. This releases the heat of fusion into the system, slowing the total heat flux out of the melt. Heat may also be held in the melt to slow solidification by incorporating a secondary material with a significantly higher heat capacity.

In another embodiment, the heat of formation is used to control heat flow during melt pool formation and/or solidification. For example, nickel microparticles may be decorated with aluminum nanoparticles. Upon supply of enough activation energy, the exothermic reaction of Ni and Al to NiAl is triggered. In this case, a large heat of formation is released (−62 kJ/mol) which may aid in melting the particles fully or partially. The resulting NiAl intermetallic is absorbed into the melt and stays suspended as a solid (a portion may be dissolved) due to its higher melting point, thereby acting as a nucleation site as well as having a strengthening effect on the alloy later.

Thermodynamic control of solidification may utilize nanoparticles/microparticles or surface coatings which undergo a phase transformation that is different from phase transformations in the base material. The phase transformations may occur at different solidus and/or liquidus temperatures, at similar solidus and/or liquidus temperatures, or at the same solidus and/or liquidus temperatures. The phase-transformed nanoparticles/microparticles or surface coatings may be incorporated into the final solid material, or may be rejected from the final solid material, or both of these. The phase-transformed nanoparticles/microparticles or surface coatings may be miscible or immiscible with the molten state. The phase-transformed nanoparticles/microparticles or surface coatings may be miscible or immiscible with the solid state.

Thermodynamic control of solidification may utilize nanoparticles/microparticles or surface coatings which vaporize or partially vaporize. For example, such coatings may comprise organic materials (e.g., waxes, carboxylic acids, etc.) or inorganic salts (e.g., $MgBr_2$, $ZnBr_2$, etc.)

Thermodynamic control of solidification may utilize nanoparticles/microparticles or surface coatings which release or absorb gas (e.g., oxygen, hydrogen, carbon dioxide, etc.).

Thermodynamic control of solidification may utilize nanoparticles/microparticles or surface coatings with different heat capacities than the base material.

In addition to controlling the energy within the system, it also is possible to control the rate at which heat leaves the system by controlling thermal conductivity or emissivity (thermal IR radiation). This type of control may be derived from a rejection to the surface or from the thermal conductivity of a powder bed during additive manufacturing, for instance. In one embodiment, the functionalization may reject to the surface a low-conductivity material, which may be the functionalization material directly or a reaction product thereof, which insulates the underlying melt and decreases the freezing rate. In other embodiments, a layer may have a high/low emissivity which would increase/decrease the radiative heat flow into or out of the system. These embodiments are particularly applicable in electron-beam systems which are under vacuum and therefore radiation is a primary heat-flow mechanism.

Additionally, in laser sintering systems, the emissivity of a rejected layer may be used to control the amount of energy input to the powder bed for a given wavelength of laser radiation. In another embodiment, the functionalized surface may be fully absorbed in the melt yet the proximity to other non-melted functionalized powders, such as additive manufacturing in a powder bed, may change the heat conduction out of the system. This may manifest itself as a low-thermal-conductivity base powder with a high-conductivity coating.

Thermal conductivity or emissivity control of solidification may utilize nanoparticles/microparticles or surface coatings which are higher in thermal conductivity compared to the base material. The nanoparticles/microparticles or surface coatings may be incorporated into the melt, or may be rejected, such as to grain boundaries or to the surface of the melt. The nanoparticles/microparticles or surface coatings may be miscible or immiscible with the molten state. The nanoparticles/microparticles or surface coatings may be miscible or immiscible with the final solid state.

Thermal conductivity or emissivity control of solidification may utilize nanoparticles/microparticles or surface coatings which are lower in thermal conductivity compared to the base material.

Thermal conductivity or emissivity control of solidification may utilize nanoparticles/microparticles or surface coatings which are higher in emissivity compared to the base material.

Thermal conductivity or emissivity control of solidification may utilize nanoparticles/microparticles or surface coatings which are lower in emissivity compared to the base material.

In some embodiments, the functionalization material may react with contaminants in the melt (e.g., Mg—Ti—O system). When the functionalization material is properly chosen, the reacted material may be selected such that the formed reaction product has a high surface tension with the liquid, such that it may be rejected to the surface. The rejected reaction product may take the form of an easily removable scale. Optionally, the rejected layer is not actually removed but rather incorporated into the final product. The rejected layer may manifest itself as a hard-facing carbide, nitride, or oxide coating, a soft anti-galling material, or any other functional surface which may improve the desired properties of the produced material. In some cases, the rejected surface layer may be of a composition and undergo a cooling regime which may result in an amorphous layer on the surface of the solidified material. These surface-rejected structures may result in improved properties related to, but not limited to, improved corrosion resistance, stress corrosion crack resistance, crack initiation resistance, overall strength, wear resistance, emissivity, reflectivity, and magnetic susceptibility.

Through contaminant removal or rejection, several scenarios are possible. Nanoparticles/microparticles or surface coatings that react with or bind to undesired contaminants may be incorporated into the solidification, in the same phase or a separate solid phase. The reacted nanoparticles/microparticles or surface coatings may be rejected during solidification. When portions or select elements present in the nanoparticles/microparticles or coatings react with or bind to contaminants, such portions or elements may be incorporated and/or rejected.

In some embodiments, the functionalized surface reacts upon heating to form a lower-melting-point material compared to the base material, such as through a eutectic reaction. The functionalized surface may be chosen from a material which reacts with the underlying powder to initiate melting at the particle surface, or within a partial volume of the underlying powder. A heat source, such as a laser or electron beam, may be chosen such that the energy density is high enough to initiate the surface reaction and not fully melt the entire functionalized powder. This results in an induced uniform liquid phase sintering at the particle surface. Upon freezing, the structure possesses a characteristic microstructure indicating different compositions and grain nucleation patterns around a central core of stock powder with a microstructure similar to the stock powder after undergoing a similar heat treatment. This structure may later be normalized or undergo post-processing to increase density or improve the properties.

Another possible reaction is a peritectic reaction in which one component melts and this melted material diffuses into a second nanoparticle or microparticle, to form an alloyed solid. This new alloyed solid may then act as a phase-nucleation center, or may limit melting just at the edge of particles.

Incorporating nanoparticles into a molten metal may be challenging when the nanoparticles have a thin oxide layer at the surface, since liquid metals typically do not wet oxides well. This may cause the nanoparticles to get pushed to the surface of the melt. One way to overcome the oxide layer on nanoparticles, and the associated wettability issues, is to form the nanoparticles in situ during melt pool formation. This may be achieved by starting with nanoparticles of an element that forms an intermetallic with one component of the base alloy, while avoiding dissolution of the nanoparticles in the melt. Alternatively, binary compound nanoparticles that disassociate at elevated temperatures, such as hydrides or nitrides, may be used since the disassociation reaction annihilates any oxide shell on the nanoparticle.

As noted above, the surface functionalization may be designed to be reacted and rejected to the surface of the melt pool. In embodiments employing additive manufacturing, layered structures may be designed. In some embodiments, progressive build layers and hatchings may be heated such that each sequential melt pool is heated long enough to reject the subsequent rejected layer, thereby producing a build with an external scale and little to no observable layering within the build of the rejected materials. In other embodiments, particularly those which result in a functional or desired material rejected to the surface, heating and hatching procedures may be employed to generate a composite structure with a layered final product. Depending on the build parameters, these may be randomly oriented or designed, layered structures which may be used to produce materials with significantly improved properties.

Architected microstructures may be designed in which feature sizes (e.g., distance between nanoparticle nodes) within the three-dimensional network are selected, along with targeted compositions, for an intended purpose. Similarly, layered composite structures may be designed in which feature sizes (e.g., layer thicknesses or distance between layers) are selected, along with targeted compositions, for an intended purpose.

Note that rejection to the surface is not necessarily required to generate layered structures. Functionalized surfaces may be relatively immobile from their initial position on the surface of the base powder. During melting, these functionalized surfaces may act as nucleation sites, as previously mentioned; however, instead of absorption into the melt, they may initiate nucleation at the location which was previously occupied by the powder surface and is not molten. The result is a fine-grained structure evolving from the surface nucleation source, towards the center. This may result in a designed composite structure with enhanced properties over the base material. In general, this mechanism allows for the ability to control the location of desired inclusions through controlled solidification.

In the additive manufacturing of titanium alloys, the problem of microstructural texturing of subsequent layers of molten metals induces anisotropic microstructures and thus anisotropic structural properties. Dispersing stable ceramic nanoparticles in the solidifying layers may produce grain structures with isotropic features which are stable upon repetitive heating cycles. An example is a stable high-temperature ceramic nanoparticle, such as $Al_2O_3$ or TiCN attached to the surface of a Ti-6Al-4V microparticle powder which is subsequently melted, solidified, and then reheated as the next layer of powder is melted on top. The ceramic nanoparticles can induce nucleation of small grains and prevent coarse grains from forming in the direction of the thermal gradient.

Any solidification control method which derives its primary functionality from the surface functionalization of a powdered material can be considered in the scope of this invention. Other methods of control may include multiple types of control described above. An example of a combination of methods includes utilizing rejection to the surface, internal reaction, along with emissivity control. For instance, a part may be processed using additive manufacturing in which a functionalization material is selected to be dissolved into the surface, and reacts to form an insoluble material which is rejected to the surface of the melt pool. This rejected material may then have a low emissivity, which reflects any additional laser radiation, thereby decreasing the local heating and cooling the material quickly to control solidification. The resulting structure is a material with a controlled solidification structure with a low-emissivity surface coating.

In some embodiments, the solid state is a three-dimensional microstructure containing the nanoparticles and/or microparticles as inclusions distributed throughout the solid state.

In some embodiments, the solid state is a layered microstructure containing one or more layers comprising the nanoparticles and/or microparticles.

The method may further include creating a structure through one or more techniques selected from the group consisting of additive manufacturing, injection molding, pressing and sintering, capacitive discharge sintering, and spark plasma sintering. The present invention provides a solid object or article comprising a structure produced using such a method.

Some variations provide a structure created from the functionalized powder via additive manufacturing. The functionalized powder (with nanoparticles/microparticles or surface coating) may be incorporated into the final structure. In some embodiments, the nanoparticles/microparticles or surface coating are rejected, creating a scale. The scale may be unbonded to the structure. In some embodiments, the scale bonds to the structure or otherwise cannot be readily removed. This may be advantageous, such as to provide a structural enhancement—for instance, rejected ceramic particles may add a hard facing to the final structure. Rejected nanoparticles/microparticles or surface coating may form a multilayer composite, wherein each layer has a different composition. In some embodiments, rejected nanoparticles/microparticles or surface coating forms a spatially graded composition within the bulk of the structure. A three-dimensional architecture may also develop in the final microstructure.

Some variations provide a solid object or article comprising at least one solid phase (i) containing a powdered material as described, or (ii) derived from a liquid form of a powdered material as described. The solid phase may form from 0.25 wt % to 100 wt % of the solid object or article, such as about 1 wt %, 5 wt %, 10 wt %, 25 wt %, 50 wt %, or 75 wt % of the solid object or article, for example.

Other variations provide a solid object or article comprising a continuous solid phase and a three-dimensional network of nanoparticle and/or microparticle inclusions distributed throughout the continuous solid phase, wherein the three-dimensional network blocks, impedes, or redirects dislocation motion within the solid object or article.

In some embodiments, the nanoparticle and/or microparticle inclusions are distributed uniformly throughout the continuous solid phase. The nanoparticle and/or microparticle inclusions may be present at a concentration from about 0.1 wt % to about 50 wt % of the solid object or article, such as about 1, 2, 5, 10, 15, 20, 25, 30, 35, 40, or 45 wt %, for example.

In some embodiments, light elements are incorporated into the system. For example, the particle surface (or the surface of nanoparticles or microparticles present on the powder particles) may be surface-reacted with an element selected from the group consisting of hydrogen, oxygen, carbon, nitrogen, boron, sulfur, and combinations thereof. For example, reaction with hydrogen gas may be carried out to form a metal hydride. Optionally, the particle or a particle coating further contains a salt, carbon, an organic additive, an inorganic additive, or a combination thereof. Certain embodiments utilize relatively inert carbides that are incorporated (such as into steel) with fast melting and solidification.

Methods of producing surface-functionalized powder materials are generally not limited and may include immersion deposition, electroless deposition, vapor coating, solution/suspension coating of particles with or without organic ligands, utilizing electrostatic forces and/or Van der Waals forces to attach particles through mixing, and so on. U.S. patent application Ser. No. 14/720,757 (filed May 23, 2015), U.S. patent application Ser. No. 14/720,756 (filed May 23, 2015), and U.S. patent application Ser. No. 14/860,332 (filed Sep. 21, 2015), each commonly owned with the assignee of this patent application, are hereby incorporated by reference herein. These disclosures relate to methods of coating certain materials onto micropowders, in some embodiments.

For example, as described in U.S. patent application Ser. No. 14/860,332, coatings may be applied using immersion deposition in an ionic liquid, depositing a more-noble metal on a substrate of a less-noble, more-electronegative metal by chemical replacement from a solution of a metallic salt of the coating metal. This method requires no external electric field or additional reducing agent, as with standard electroplating or electroless deposition, respectively. The metals may be selected from the group consisting of aluminum, zirconium, titanium, zinc, nickel, cobalt copper, silver, gold, palladium, platinum, rhodium, titanium, molybdenum, uranium, niobium, tungsten, tin, lead, tantalum, chromium, iron, indium, rhenium, ruthenium, osmium, iridium, and combinations or alloys thereof.

Organic ligands may be reacted onto a metal, in some embodiments. Organic ligands may be selected from the group consisting of aldehydes, alkanes, alkenes, silicones, polyols, poly(acrylic acid), poly(quaternary ammonium salts), poly(alkyl amines), poly(alkyl carboxylic acids) including copolymers of maleic anhydride or itaconic acid, poly(ethylene imine), poly(propylene imine), poly(vinylimidazoline), poly(trialkylvinyl benzyl ammonium salt), poly (carboxymethylcellulose), poly(D- or L-lysine), poly(L-glutamic acid), poly(L-aspartic acid), poly(glutamic acid), heparin, dextran sulfate, 1-carrageenan, pentosan polysulfate, mannan sulfate, chondroitin sulfate, and combinations or derivatives thereof.

The reactive metal may be selected from the group consisting of alkali metals, alkaline earth metals, aluminum, silicon, titanium, zirconium, hafnium, zinc, and combinations or alloys thereof. In some embodiments, the reactive metal is selected from aluminum, magnesium, or an alloy containing greater than 50 at % of aluminum and/or magnesium.

Some possible powder metallurgy processing techniques that may be used include but are not limited to hot pressing, low-pressure sintering, extrusion, metal injection molding, and additive manufacturing.

The final article may have porosity from 0% to about 75%, such as about 5%, 10%, 20%, 30%, 40%, 50%, 60%, or 70%, in various embodiments. The porosity may derive from space both within particles (e.g., hollow shapes) as well as space outside and between particles. The total porosity accounts for both sources of porosity.

The final article may be selected from the group consisting of a sintered structure, a coating, a weld filler, a billet, an ingot, a net-shape part, a near-net-shape part, and combinations thereof. The article may be produced from the coated reactive metal by a process comprising one or more techniques selected from the group consisting of hot pressing, cold pressing, sintering, extrusion, injection molding, additive manufacturing, electron-beam melting, selective laser sintering, pressureless sintering, and combinations thereof.

In some embodiments of the invention, the coated particles are fused together to form a continuous or semi-continuous material. As intended in this specification, "fused" should be interpreted broadly to mean any manner in which particles are bonded, joined, coalesced, or otherwise combined, at least in part, together. Many known techniques may be employed for fusing together particles.

In various embodiments, fusing is accomplished by sintering, heat treatment, pressure treatment, combined heat/pressure treatment, electrical treatment, electromagnetic treatment, melting/solidifying, contact (cold) welding, solution combustion synthesis, self-propagating high-temperature synthesis, solid state metathesis, or a combination thereof.

"Sintering" should be broadly construed to mean a method of forming a solid mass of material by heat and/or pressure without melting the entire mass to the point of liquefaction. The atoms in the materials diffuse across the boundaries of the particles, fusing the particles together and creating one solid piece. The sintering temperature is typically less than the melting point of the material. In some embodiments, liquid-state sintering is used, in which some but not all of the volume is in a liquid state.

When sintering or another heat treatment is utilized, the heat or energy may be provided by electrical current, electromagnetic energy, chemical reactions (including formation of ionic or covalent bonds), electrochemical reactions, pressure, or combinations thereof. Heat may be provided for initiating chemical reactions (e.g., to overcome activation energy), for enhancing reaction kinetics, for shifting reaction equilibrium states, or for adjusting reaction network distribution states.

Some possible powder metallurgy processing techniques that may be used include, but are not limited to, hot pressing, sintering, high-pressure low-temperature sintering, extrusion, metal injection molding, and additive manufacturing.

A sintering technique may be selected from the group consisting of radiant heating, induction, spark plasma sintering, microwave heating, capacitor discharge sintering, and combinations thereof. Sintering may be conducted in the presence of a gas, such as air or an inert gas (e.g., Ar, He, or $CO_2$), or in a reducing atmosphere (e.g., $H_2$ or CO).

Various sintering temperatures or ranges of temperatures may be employed. A sintering temperature may be about, or less than about, 100° C., 200° C., 300° C., 400° C., 500° C., 600° C., 700° C., 800° C., 900° C., or 1000° C.

A sintering temperature is preferably less than the reactive-metal melting temperature. In some embodiments, a sintering temperature may be less than a maximum alloy melting temperature, and further may be less than a minimum alloy melting temperature. In certain embodiments, the sintering temperature may be within the range of melting points for a selected alloy. In some embodiments, a sintering temperature may be less than a eutectic melting temperature of the particle alloy.

At a peritectic decomposition temperature, rather than melting, a metal alloy decomposes into another solid compound and a liquid. In some embodiments, a sintering temperature may be less than a peritectic decomposition temperature of the metal alloy. If there are multiple eutectic melting or peritectic decomposition temperatures, a sintering temperature may be less than all of these critical temperatures, in some embodiments.

In some embodiments pertaining to aluminum alloys employed in the microparticles, the sintering temperature is preferably selected to be less than about 450° C., 460° C., 470° C., 480° C., 490° C., or 500° C. The decomposition temperature of eutectic aluminum alloys is typically in the range of 400-600° C. (Belov et al., *Multicomponent Phase Diagrams: Applications for Commercial Aluminum Alloys,* Elsevier, 2005), which is hereby incorporated by reference herein.

A solid article may be produced by a process selected from the group consisting of hot pressing, cold pressing and sintering, extrusion, injection molding, additive manufacturing, electron beam melting, selected laser sintering, pressureless sintering, and combinations thereof. The solid article may be, for example, a coating, a coating precursor, a substrate, a billet, an ingot, a net shape part, a near net shape part, or another object.

EXAMPLES

Example 1: Production of AlSi10Mg—WC Functionally Graded Metal Matrix Nanocomposite In this example, a functionally graded metal matrix nanocomposite is produced, with AlSi10Mg alloy and tungsten carbide (WC) nanoparticles. The starting AlSi10Mg alloy has an approximate composition of 10 wt % silicon (Si), 0.2-0.45 wt % magnesium (Mg), and the remainder aluminum (Al) except for impurities (e.g., Fe and Mn). The density of tungsten carbide 15.6 g/cm$^3$ and the density of AlSi10Mg is 2.7 g/cm$^3$. The tungsten carbide nanoparticles have a typical particle size of 15 nm to 250 nm.

Tungsten carbide nanoparticles are assembled on an AlSi10Mg alloy powder. This material is consolidated under 300 MPa compaction force and then melted in an induction heater at 700° C. for one hour. The resulting material (FIG. 10) exhibits a functional gradient according to the distribution of WC nanoparticles. FIG. 10 is an SEM image of a cross-section (side view) of the resulting AlSi10Mg—WC functionally graded metal matrix nanocomposite.

This is an example of density-driven phase separation of high-density tungsten carbide nanoparticles segregated to the bottom of a matrix of aluminum alloy. Melting of the ingot induces spontaneous segregation of the WC nanoparticles, of higher density than the AlSi10Mg, to the bottom of the melt; and voids, of lower density than the AlSi10Mg, to the top of the melt. The induction melting of the predistributed ingot preserves the integrity and dispersion of the WC nanoparticles and mitigates reaction between the nanoparticles and the AlSi10Mg matrix, preventing significant agglomeration of nanoparticles.

Example 2: Production of AlSi10Mg—WC Master Alloy Metal Matrix Nanocomposite

In this example, a master alloy metal matrix nanocomposite is produced, with AlSi10Mg alloy and tungsten carbide (WC) nanoparticles.

A functionally graded metal matrix nanocomposite is first produced according to Example 1. The material shown in FIG. 10 is the precursor to the master alloy. According to FIG. 10, the tungsten carbide nanoparticles are preferentially located (functionally graded) toward the bottom of the structure. This is also analogous to the schematic of FIG. 6. The AlSi10Mg alloy (metal matrix phase) toward the top contains little or no tungsten carbide nanoparticles. The desired material for this master alloy is the lower phase, containing a higher volume of tungsten carbide nanoparticles distributed within the AlSi10Mg phase.

The AlSi10Mg alloy (metal matrix phase) labeled "AlSi" is then separated from the lower phase labeled "AlSi+WC". The resulting material is a master alloy metal matrix nanocomposite. FIG. 11 is an SEM image of a cross-section (side view) of the microstructure of the resulting AlSi10Mg—WC master alloy metal matrix nanocomposite. There is a well-distributed network of WC nanoparticles in a high-volume-fraction nanocomposite without significant nanoparticle accumulation.

This master alloy metal matrix nanocomposite example of AlSiMg alloy with a hard reinforcement phase of tungsten carbide nanoparticles demonstrates the use of a pre-dispersed ingot in the process of density-driven phase separation. The total volume fraction of WC to metal matrix is increased from the pre-dispersed ingot by phase segregation.

Limitations in cost, availability, and performance impede progress of metal matrix composites across several industries. Variations of this invention provide an efficient, low-cost route to manufacturing metal matrix nanocomposites. The versatility of this method enables systems of reinforcement and metal matrix composite components to be manufactured with a high performance potential in many different applications.

Commercial applications include high-wear-resistant alloy systems, creep-resistant alloys, high-temperature alloys with improved mechanical properties, high thermal-gradient applications, radiation-tolerant alloys, high-conductivity and high-wear-resistant injection molding dies, turbine disks, automotive and aviation exhaust system components, and nuclear shielding, for example. This invention provides near-net-shape casting of objects with complex surfaces, maintaining functionally graded reinforcement across the designed surfaces. Density-driven phase separation in casting can result in thick functionally graded products.

Other specific applications may include gearing applications where the functional gradient acts as a case hardening; pistons with hard facing for improved wear and thermal behavior; high-conductivity, wear-resistant tooling; rotating fixtures such as shafts and couplers; engine valves; cast structures of lightweight metals; high-conductivity structural materials; wear-resistant materials; impact surfaces; creep-resistant materials; corrosion-resistant materials; and high electrical-conductivity metals.

In this detailed description, reference has been made to multiple embodiments and to the accompanying drawings in which are shown by way of illustration specific exemplary embodiments of the invention. These embodiments are described in sufficient detail to enable those skilled in the art to practice the invention, and it is to be understood that modifications to the various disclosed embodiments may be made by a skilled artisan.

Where methods and steps described above indicate certain events occurring in certain order, those of ordinary skill in the art will recognize that the ordering of certain steps may be modified and that such modifications are in accordance with the variations of the invention. Additionally, certain steps may be performed concurrently in a parallel process when possible, as well as performed sequentially.

All publications, patents, and patent applications cited in this specification are herein incorporated by reference in their entirety as if each publication, patent, or patent application were specifically and individually put forth herein.

The embodiments, variations, and figures described above should provide an indication of the utility and versatility of the present invention. Other embodiments that do not provide all of the features and advantages set forth herein may also be utilized, without departing from the spirit and scope of the present invention. Such modifications and variations are considered to be within the scope of the invention defined by the claims.

What is claimed is:

1. A composition comprising metal-containing microparticles and nanoparticles, wherein said nanoparticles are chemically and/or physically disposed on surfaces of said microparticles, wherein said nanoparticles are consolidated in a three-dimensional architecture throughout said composition, and wherein said composition has an equiaxed, fine-grained, dispersed microstructure with a dispersion length scale from 10 nanometers to 1 micron, wherein said dispersion length scale is calculated as the average length scale of said metal-containing microparticles between said nanoparticles.

2. The composition of claim 1, wherein said composition is an ingot for producing a metal nanocomposite.

3. The composition of claim 1, wherein said composition is a metal nanocomposite.

4. The composition of claim 1, wherein said microparticles contain an element selected from the group consisting of Al, Mg, Ni, Fe, Cu, Ti, V, Si, and combinations thereof.

5. The composition of claim 1, wherein said nanoparticles contain a compound selected from the group consisting of metals, ceramics, cermets, intermetallic alloys, oxides, carbides, nitrides, borides, polymers, carbon, and combinations thereof.

6. The composition of claim 1, wherein said microparticles contain Al, Si, and Mg, and wherein said nanoparticles contain tungsten carbide (WC).

7. The composition of claim 1, wherein said nanoparticles have an average nanoparticle size from about 1 nanometer to about 1000 nanometers.

8. The composition of claim 1, wherein said composition contains from about 10 wt % to about 99.9 wt % of said microparticles.

9. The composition of claim 1, wherein said composition contains from about 0.1 wt % to about 10 wt % of said nanoparticles.

* * * * *